US007434908B2

(12) United States Patent
Ohmori et al.

(10) Patent No.: US 7,434,908 B2
(45) Date of Patent: Oct. 14, 2008

(54) IMAGE CREATION AND CUTTING SYSTEM

(75) Inventors: Hisao Ohmori, Shizuoka-ken (JP); Yuji Sakata, Shizuoka-ken (JP)

(73) Assignee: Roland DG Corporation, Hamamatsu-shi (JP)

( * ) Notice: Subject to any disclaimer, the term of this patent is extended or adjusted under 35 U.S.C. 154(b) by 422 days.

(21) Appl. No.: 11/098,915

(22) Filed: Apr. 4, 2005

(65) Prior Publication Data

US 2005/0225595 A1 Oct. 13, 2005

(30) Foreign Application Priority Data

Apr. 7, 2004 (JP) ..... 2004-113371
Apr. 28, 2004 (JP) ..... 2004-133654

(51) Int. Cl.
*B41J 23/00* (2006.01)

(52) U.S. Cl. ..... 347/37

(58) Field of Classification Search ..... 347/37, 347/104

See application file for complete search history.

(56) References Cited

U.S. PATENT DOCUMENTS 4,832,512 A * 5/1989 Perville et al. ..... 400/18
6,036,300 A * 3/2000 Suzuki et al. ..... 347/41

FOREIGN PATENT DOCUMENTS

JP 09029685 A * 2/1997

* cited by examiner

*Primary Examiner*—An H Do
(74) *Attorney, Agent, or Firm*—Lee, Hong, Degerman, Kang & Waimey

(57) ABSTRACT

A printer for creating and cutting an image to be processed on an object includes a first guide rail extended in a specified direction, a second guide rail positioned parallel to the first guide rail, a first carriage supported on the first guide rail for movement on the first guide rail, a second carriage supported on the second guide rail for movement on the second guide rail, an inkjet head which is detachably coupled to the first carriage for movement on the first guide rail and emits ink onto the object to create the image, a cutting head which is supported by the second carriage for movement on the second guide rail and cuts the object, drive motor for moving the cutting head and the inkjet head, and a controller for providing control information to the drive motor.

25 Claims, 17 Drawing Sheets

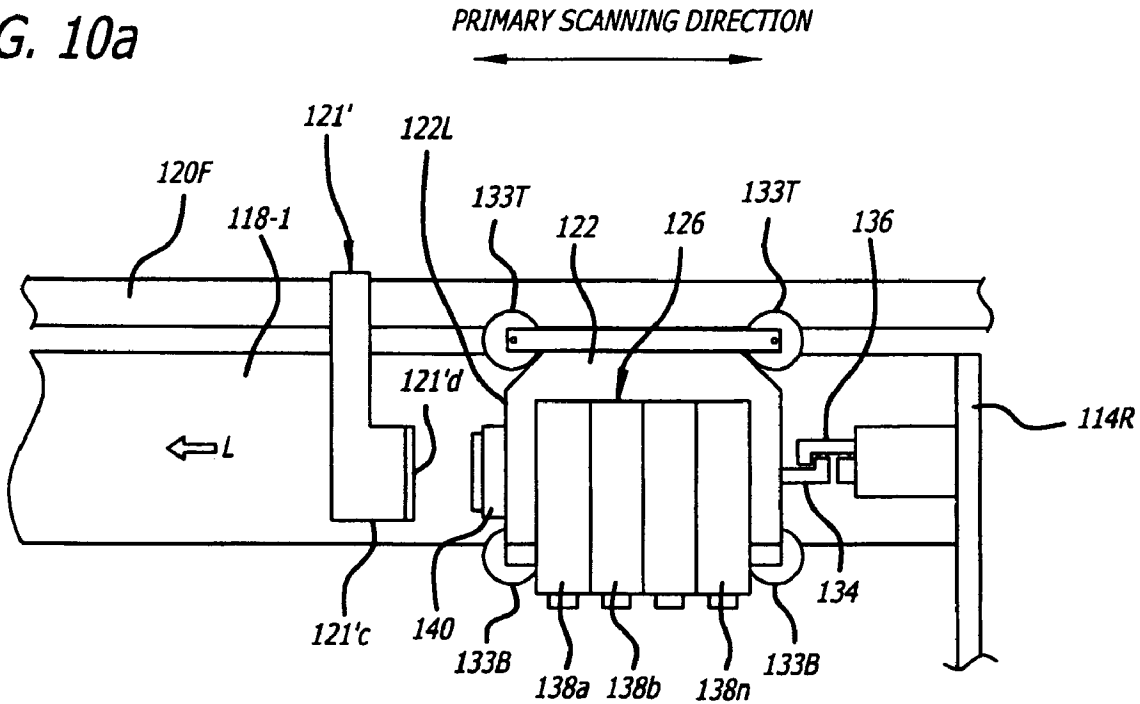
FIG. 10a
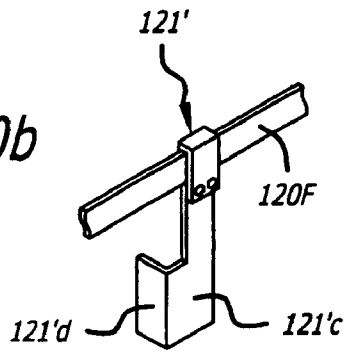
FIG. 10b
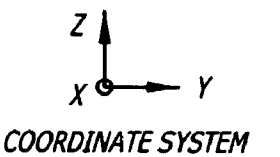

COORDINATE SYSTEM

IMAGE CREATION AND CUTTING SYSTEM

CROSS-REFERENCE TO RELATED APPLICATIONS

Pursuant to 35 U.S.C. § 119(a), this application claims the benefit of earlier filing date and right of priority to Japanese Application No. 2004-113371, filed on Apr. 7, 2004, and Japanese Application No. 2004-133654, filed on Apr. 28, 2004, the contents of which are hereby incorporated by reference herein in their entirety.

BACKGROUND OF THE INVENTION

1. Field of the Invention

The present invention relates to a system and method for creating and cutting an image, and particularly, to a system having a cutting head and an inkjet head mechanism in which both heads are separately controllable and/or detachable from each other in response to image data.

2. Description of the Related Art

Printing systems, such as inkjet printers and the like, have demonstrated high resolution printing capabilities. High-resolution printers require an extended time-period for processing and printing an image as compared to low-resolution printers. Systems proposed include printing and cutting capabilities. However, these proposed systems have drawbacks, such as increased complexity, component count, and time required for image processing, printing, and cutting.

Therefore, there is a need for a system for printing and cutting images on items to be processed that provide advantages and improvements over the conventional printing and cutting approaches.

SUMMARY OF THE INVENTION

Features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

In one embodiment, a system is provided for creating and cutting an image to be processed on a surface of an object. The system comprises a guide rail that extends in a specified direction, and an inkjet head supported on the guide rail for movement along the specified direction on the guide rail, wherein ink from the inkjet head is emitted and the image is created on the surface in response to image data. A cutting head is supported on the guide rail for movement along the specified direction on the guide rail for cutting of the image in response to the image data. A first driving means moves the inkjet head along the specified direction on the guide rail. A second driving means moves the cutting head along the specified direction on the guide rail. A controller provides control information to the first driving means and the second driving means.

In another embodiment, a system is disclosed for creating and cutting an image to be processed on a surface of a sheet. The system comprises a first guide rail extended in a specified direction, a second guide rail extended in the specified direction, and an inkjet head supported on the first guide rail for providing movement along the specified direction on the surface, wherein ink from the inkjet head is emitted onto the surface and the image is created. A cutting head is supported on the second guide rail for movement along the specified direction on the second guide rail on a sheet, wherein the cutting head performs cutting on the sheet in response to image data. A first driving means is provided in which the inkjet head is driven in the specified direction along the first guide rail. A second driving means is provided in which the cutting head is driven in the specified direction along the second guide rail. A controller controls the first driving means and the second driving means.

Additional features and advantages of the invention will be set forth in the description which follows, and in part will be apparent from the description, or may be learned by practice of the invention. It is to be understood that both the foregoing general description and the following detailed description of the present invention are exemplary and explanatory and are intended to provide further explanation of the invention as claimed.

These and other embodiments will also become readily apparent to those skilled in the art from the following detailed description of the embodiments having reference to the attached figures, the invention not being limited to any particular embodiments disclosed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

Features, elements, and aspects of the invention that are referenced by the same numerals in different figures represent the same, equivalent, or similar features, elements, or aspects in accordance with one or more embodiments.

FIG. 10*a* is a front view illustrating the inkjet head and the moving carriage, in accordance with the first embodiment of the present invention.

FIG. 10*b* is a side view illustrating the moving carriage, in accordance with the first embodiment of the present invention.

DETAILED DESCRIPTION OF THE PREFERRED EMBODIMENTS

The present invention relates to an image creation and cutting apparatus. In particular, the present invention relates to an ink jet printer that prints and cuts an image on an item to be processed. Moreover, the present invention is designed with a simplified configuration resulting in reduced system costs.

Although the invention is illustrated with respect to an ink jet printer, the invention may be utilized to realize a printer having improved image creation and cutting capabilities. Reference will now be made in detail to the preferred embodiments of the present invention, examples of which are illustrated in the accompanying drawings.

The following defined terms are used through out the specification and claims. The image creation and cutting system 100 utilizes a sheet 190, such as a single sheet, a long rolled sheet, or the like. A direction along a width of the sheet 190, hereinafter, will be referred to as the "primary scanning direction". A direction perpendicular to the primary scanning direction, i.e., the direction along a length of the sheet 190 or the direction of feeding the sheet 190, hereinafter is referred to as the "secondary scanning direction." As illustrated in FIGS. 1 and 2, the primary scanning direction coincides with a Y-axis direction in an XYZ Cartesian coordinate system while the secondary scanning direction coincides with an X-axis direction.

Figure 4:
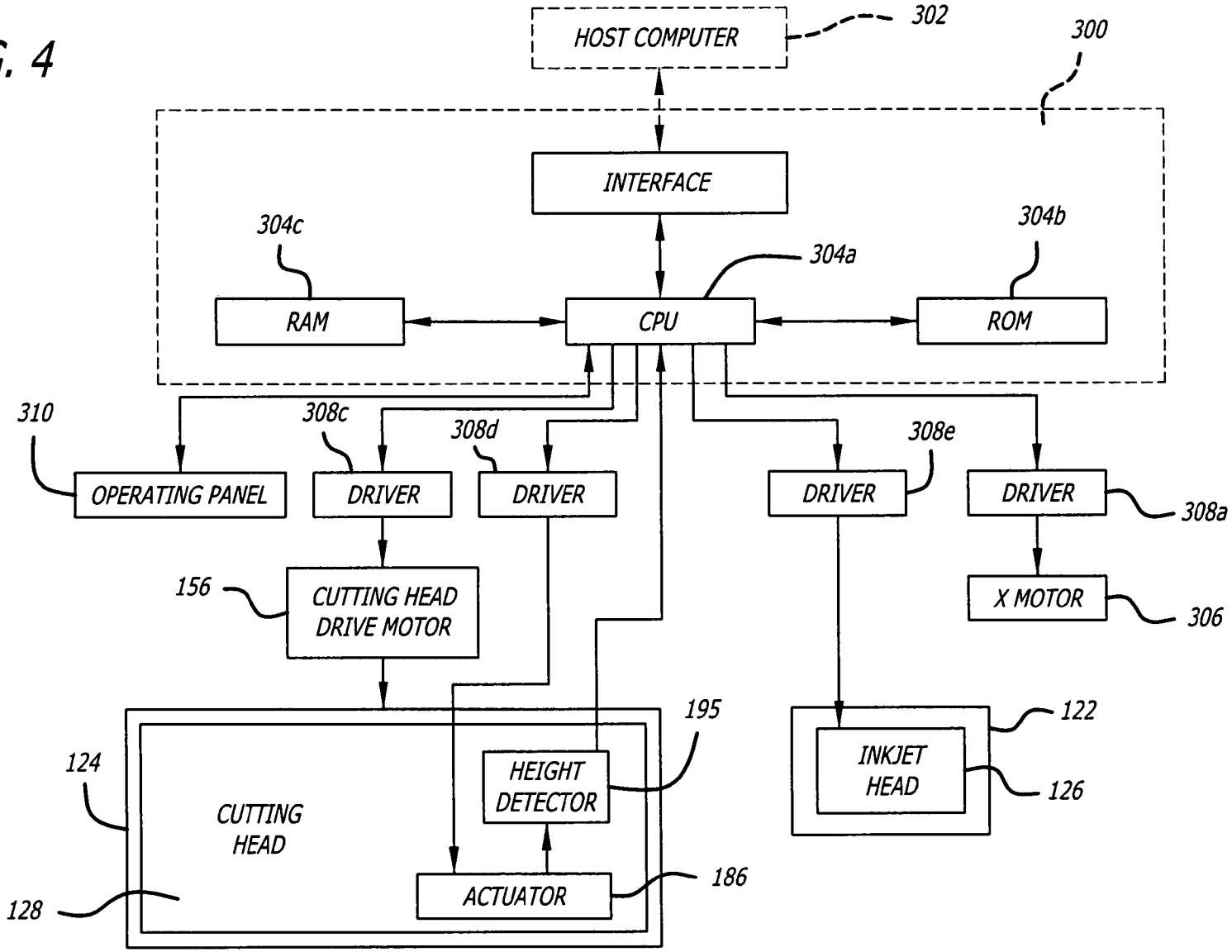
FIG. 4 is a block diagram illustrating a method for controlling the image creation and cutting system, in accordance with the first embodiment of the present invention.

The overall operation of the image creation and cutting system 100 is controlled by an image data signal from a microcomputer 300, as shown in FIG. 4. Preferably, the microcomputer 300 receives a data signal from a host computer 302.

Figure 1:
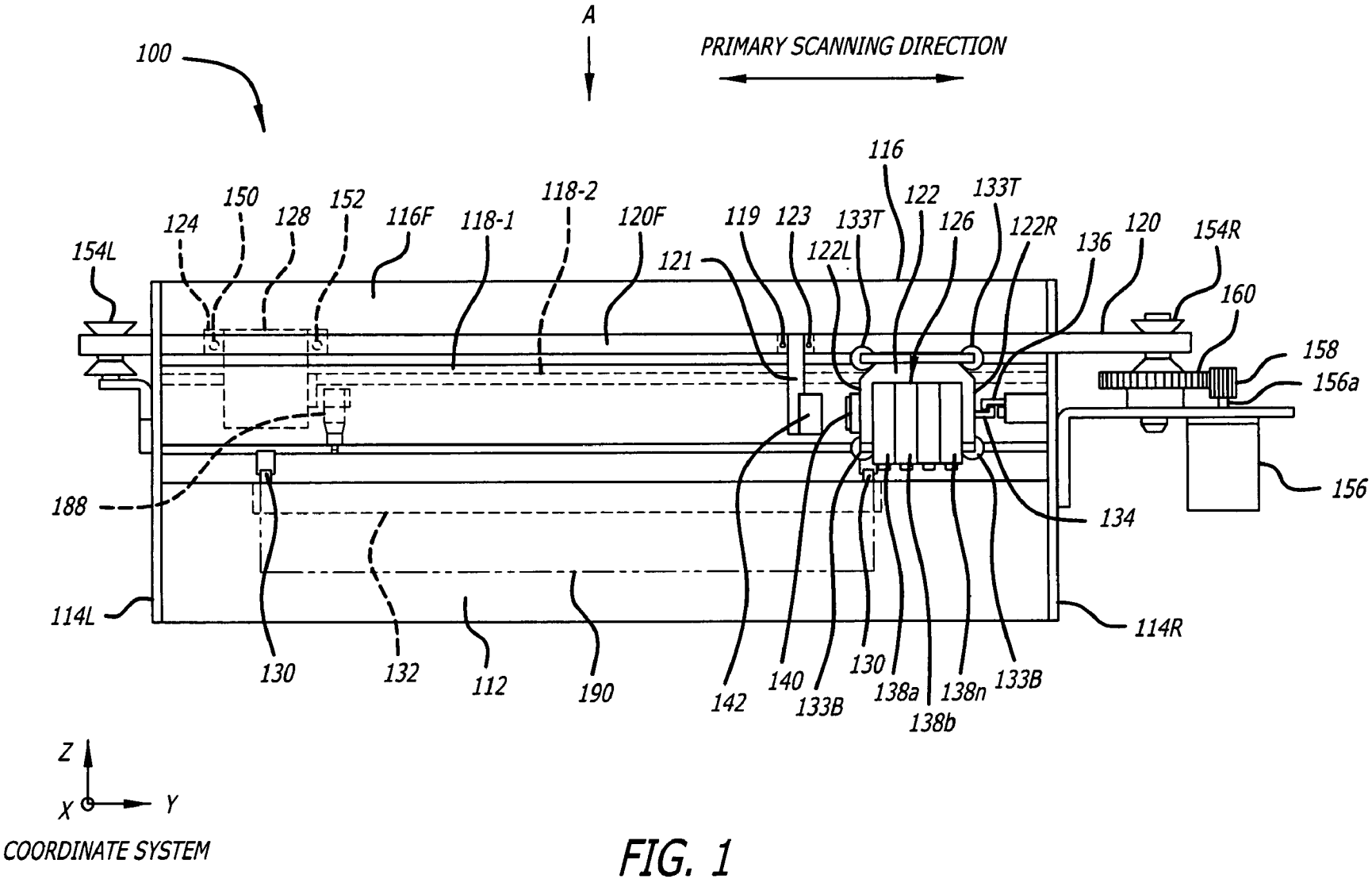
FIG. 1 is a front view of an image creation and cutting system, in accordance with a first embodiment of the present invention.
Figure 2:
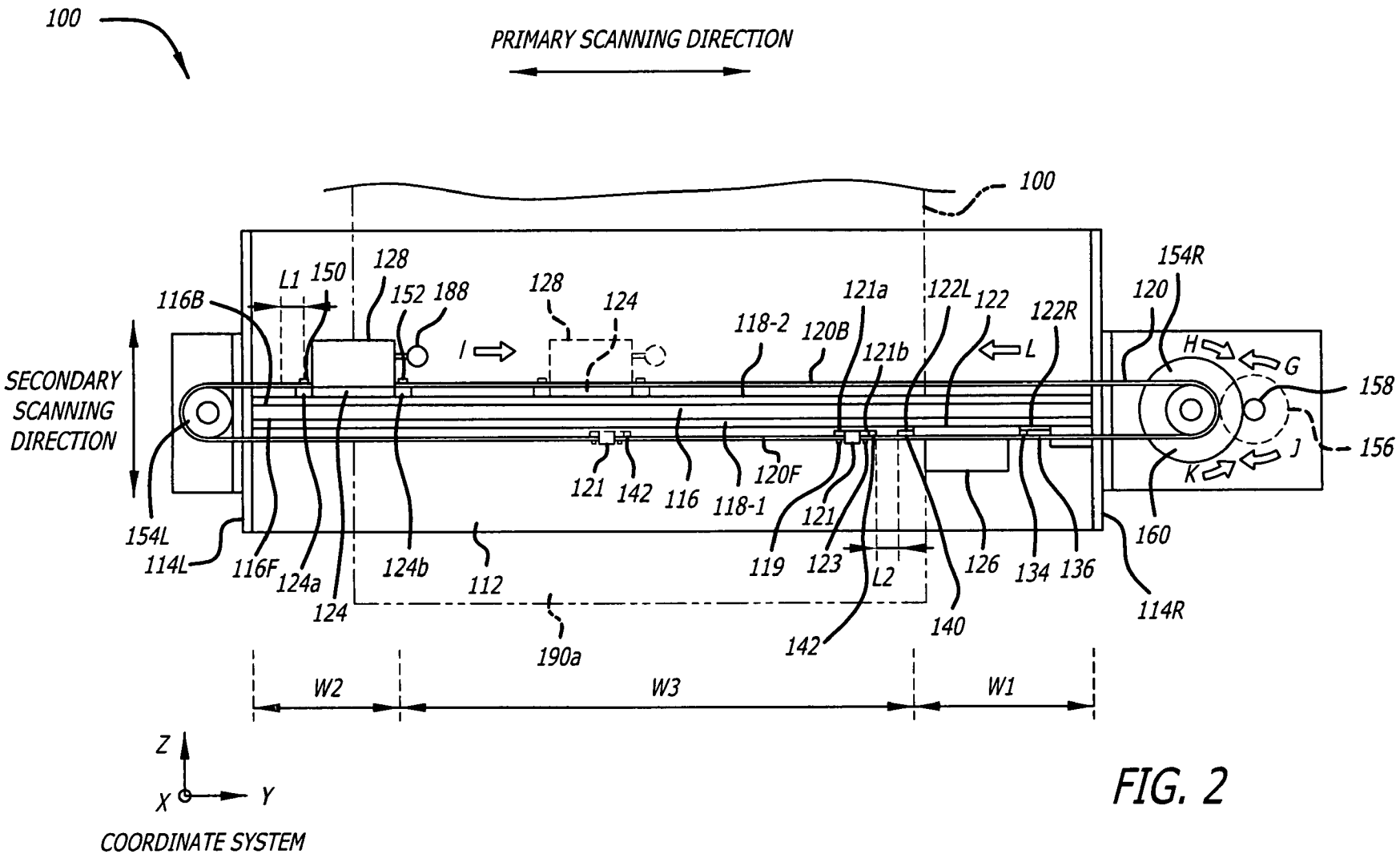
FIG. 2 is a partial top view of FIG. 1.

FIG. 1 is a front view of an image creation and cutting system in accordance with a first embodiment of the present invention. FIG. 2 is a partial top view of FIG. 1. Referring to FIGS. 1 and 2, the image creation and cutting system 100 comprises a fastening group base member 112 extending in the primary scanning direction. Fastening group side frames 114L, 114R, are located respectively on the left and right sides of the fastening group base member 112. Preferably, the fastening group side frames 114L, 114R are perpendicular to the fastening group base member 112. A middle wall 116 is linked to the left and right side frames 114L, 114R. A guide rail 118-1 extends in the primary scanning direction on a front surface 116F of the middle wall 116. A guide rail 118-2 extends in the primary scanning direction on a back surface 116B of the middle wall 116. A drive belt 120 couples the middle wall 116 and the guide rails 118-1, 118-2 for belt movement in the primary scanning direction. A moving carriage 121 fastens to a specified location on a moveable front surface side member 120F of the drive belt 120 parallel to the front surface 116F of the middle wall 116. A carriage 122 slidably mounts on the guide rail 118-1. A carriage 124, which is parallel to the back surface 116B of the middle wall 116, fastens to a back surface side member 120B of the drive belt 120.

Preferably, the carriage 124 moves while connected to the back surface side member 120B for sliding on the guide rail 118-2. An inkjet head 126 is disposed on the carriage 122, wherein the inkjet head 126 faces opposite the sheet 190 on the fastening group base member 112. A cutting head 128 is disposed on the carriage 124, wherein the cutting head 128 faces opposite the sheet 190 on the fastening group base member 112.

A key 130 is a pinch roller disposed above the fastening group base member 112 and presses the sheet 190 onto the fastening group base member 112. The sheet 190 is held between the pinch roller and a grid roller 132 disposed below the fastening group base member 12. Accordingly, when the grid roller 32 is rotated by a stepping motor, the sheet 190 is fed along the secondary scanning direction (the X-axis direction).

An operating panel 310, as shown in FIG. 4, provides instructions for controlling the operation of the image creation and cutting system 100. On the operating panel 310, a display section with which an operating state is displayed, a cursor key that specifies the position of the inkjet head 126 and the cutting head 128, a start region setting key for designating a region of the specified member that should start the creation or cutting of the image based on a image data signal, a creation start key for starting the creation or the cutting of the image from the start region that has been set, and the like are arranged.

The carriage 122 supports the inkjet head 126 for movement in the primary scanning direction (Y-axis direction) on the guide rail 118-1. The inkjet head 126 is disposed on upper and lower guide rollers 133T, 133B of the carriage 122 for slidably mounting along the guide rail 118-1.

On a left sidewall 122L of the carriage 122, a first magnet 142 and a second magnet 140 are provided. A hook 134 is disposed on the right side wall 122R of the carriage 122. The hook 134 may be latched or detached from a latching hook 136 affixed to the side frame 114R.

A fastening section with which the inkjet head 126 is fastened to the fastening group base member 112 so that the section is free to be detached comprises the hook 134 and the latching hook 136. The latching and detaching of the hook 134 and the latching hook 136 are controlled by operating keys, which are disposed on the operating panel 310 (refer to FIG. 4).

The ink jet head 126 is disposed on the carriage 122 and comprises a plurality of inkjet nozzles 138*a*, 138*b*, . . . , 138*n*, wherein n is a positive integer. The inkjet nozzles 138*a*-138*n* are supplied with respectively different colored inks from ink tanks. The inkjet nozzles 138*a*-138*n* are selected in response to an image data signal and colored ink is sprayed through the selected inkjet nozzles 138*a*-138*n*. Thus, a desired colored image may be produced on a surface 190*a* of the sheet 190.

The carriage 124 supports the cutting head 128 for movement along the guide rail 118-2 in the primary scanning direction (Y-axis direction). Ends of the drive belt 120 are respectively coupled by screws 150, 152 to the attachment sections 124*a*, 124*b* located on the two left and right edge sections of the carriage 124.

The drive belt 120 attached to the carriage 124 is connected at one end to the pulley 154L attached to the side frame 114L, and at the other end to the pulley 154R attached to the side frame 114R. The drive belt 120 is arranged such that the belt encircles the center wall 116 and the guide rails 118-1, 118-2.

Referring to FIG. 2, the front surface side member 120F of the drive belt 120 is arranged parallel to the front surface 116F of the middle wall 116 has been. The back surface side member 120B of the drive belt 120 is arranged parallel to the back surface 116B of the middle wall 116. Referring to FIG. 1, the front surface side member 120F of the drive belt 120 that is arranged parallel to the front surface 116F of the middle wall 116 has been arranged such that the member 120F is positioned on the side above the guide rail 118-1. The back surface side member 120B of the drive belt 120 that is disposed parallel to the back surface 116B of the middle wall 116 has been arranged such that the member 120B is positioned on the side above the guide rail 118-2.

The cutting head drive motor 156 attaches on the side frame 114R. The motor gear 158 attaches to the axis of rotation of the motor 156 and the gear 160, which is disposed on the same axis as the pulley 154R, and meshes with the motor gear 158.

In one state, rotation of the axis of rotation 156*a* due to the rotation of the cutting head drive motor 156 transfers rotation force from the motor 156 to the pulley 154R through the motor gear 158 and the gear 160. The rotational movement of the pulley 154R then causes the drive belt 120 to move, resulting in the carriage 124 moving in the primary scanning direction on the guide rail 118-2.

In another state, rotation of the axis of rotation 156*a* of the cutting head drive motor 156 along the arrow G direction causes the pulley 154R to rotate in the direction of the arrow H. The carriage 124 attached on the back surface side 120B of the drive belt 120 moves along the direction of the arrow I in the primary scanning direction on the back surface 116B side of the middle wall 116. Consequently, the cutting head 128 on the carriage 124 moves in the primary scanning direction along the back surface 16B of the middle wall 16 from the side frame 114L to the side frame 114R In yet another state, rotation of the axis of rotation 156*a* of the cutting head drive motor 156 along the arrow J direction causes the pulley 154R to rotate in the direction of the arrow K. The carriage 124, on the back surface side member 120B of the drive belt 120, moves in the primary scanning direction in the direction of the arrow L on the back surface 116B of the middle wall 116. Consequently, the cutting head 128 on the carriage 124 moves in the primary scanning direction on the back surface 116B of the middle wall 116 from the side frame 114R to the side frame 114L.

Figure 3A:
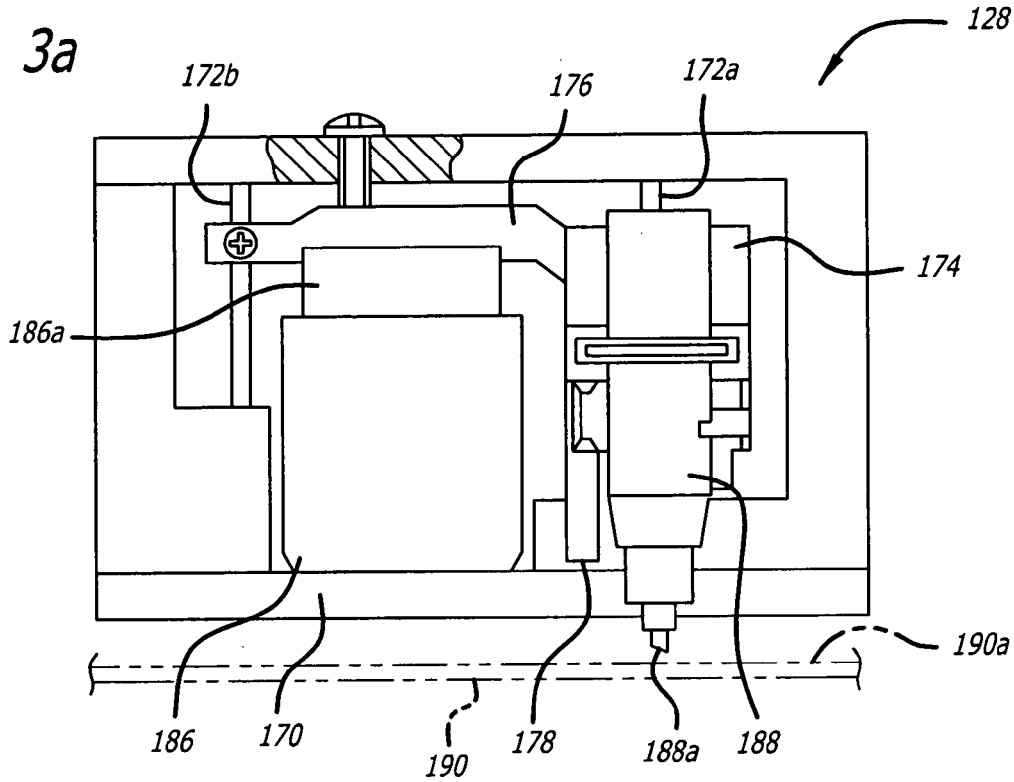
FIG. 3*a* is a front view of a cutting head of FIG. 1, in accordance with the first embodiment of the present invention.
Figure 3B:
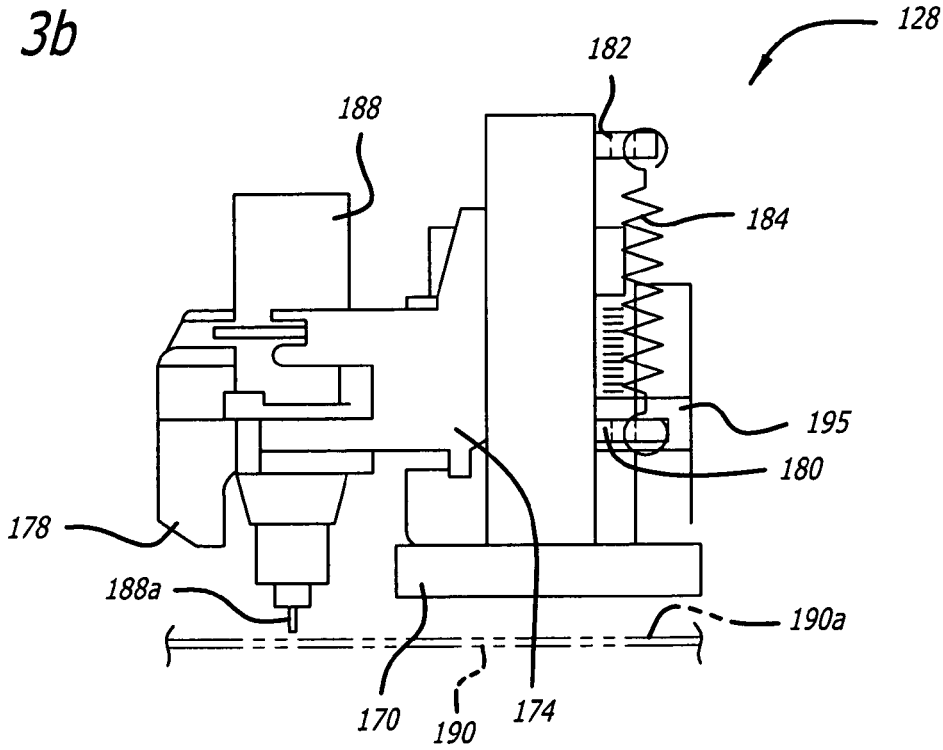
FIG. 3*b* is a side view of the cutting head, in accordance with the first embodiment of the present invention.

FIG. 3*a* is a front view of a cutting head of FIG. 1 in accordance with one embodiment of the present invention. FIG. 3*b* is a side view of the cutting head in accordance with one embodiment of the present invention.

A detailed explanation hereinafter involves the cutting head 128 moving in the primary scanning direction. The movement of the carriage 124 slidably mounted on the guide rail 118-2 utilizing the drive belt is shown in FIGS. 3*a* and 3*b*.

The cutting head 128 comprises a frame shaped carriage base 170, guide rods 172*a*, 172*b* that extend vertically and are parallel to the left and right sides, and a cutter holder 174 attached to the guide rods 172*a*, 172*b* for free vertical movement.

The cutter holder 174 comprises two pen retention sections 178, which possess catching and holding claws, and protrude from one end of the rear section 176 attached to the guide rods 172*a*, 172*b* toward the front. The cutter holder 174 is pulled upward by a coil spring 184, wherein the coil spring 184 is suspended across a hooking piece 180 and a hooking piece 182. The hooking piece 180 is disposed protruding from one end rear section of the cutter holder 174 while the hooking piece 182 is disposed on top of one end rear section of the carriage base 70.

A key 186 is an actuator provided at the other end section on the bottom of the carriage base 170 and links an upper section moving section 186*a* to the rear section 176 of the cutter holder 174. Preferably, action of the actuator, i.e., the key 186, causes compression of the coil spring 184 for moving the cutter holder 174 upward, or extension of the coil spring 184 for moving the cutter holder 174 downward.

A key 188 is a cutter blade held in the pen retention section 178 of the cutter holder 174 and is installed in a tip section so that the cutting blade may be replaced. A key 195 is a height detection device operated by the actuator 186 preferably from a stopped position of the cutter holder 174. The actuator 186 makes it possible to bring the cutter blade 188*a* into contact with a surface 190*a* of the sheet 190. Preferably, the cutter blade 188*a* is a swivel knife type, rotating type, or the like. Ordinary cutting instruments, ultrasonic cutters, heat cutters, and the like may also be employed for the cutter blade 188*a*.

The first magnet 142 of the moving carriage 121 magnetically attaches to the second magnet 140 disposed on the left side wall 122L of the carriage 122 to form a linking section. Movement of the first magnet 140 of the carriage 122 disposed with the inkjet head 126 proximal to the second magnet 142 of the moving carriage 121 causes either a linked state or a detached state of the carriages 121, 122.

Figure 8:
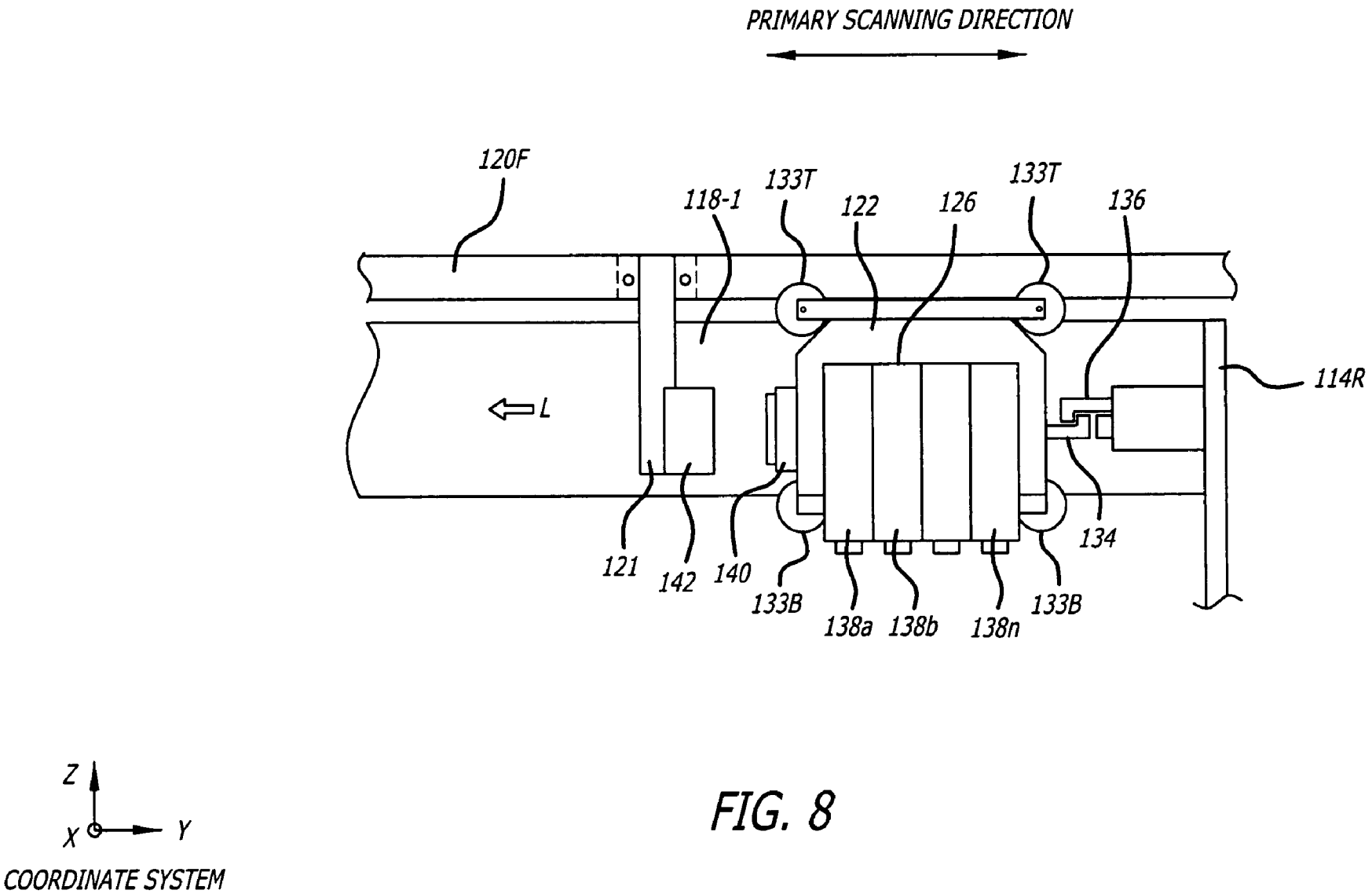
FIG. 8 is a front view illustrating a disconnected state of the moving carriage and the inkjet head of FIG. 1, in accordance with the first embodiment of the present invention.

As shown in FIG. 8, magnetic attraction between the first magnet 140 and the second magnet 142 creates a magnetic attachment force. However, this force is less than the holding force of the locked state in which the hook 134 of the carriage 122 and the latching hook 136 are latched. Ends of the drive belt 120 are respectively attached using screws 119, 123 onto the attachment sections 121*a*, 121*b* on the left and right edge sections on the top of the moving carriage 121. The moving carriage 121, affixed in a specified position on the front surface side member 120F of the drive belt 120, is supported for movement in the primary scanning direction along the front surface 116F of the middle wall 116.

The carriage 124 is fastened to the back surface member 20B on the drive belt 120 connected with the moving carriage 121. The drive belt 120 moves by means of the driving force of the cutting head drive motor 156, referring to the G, H, I, J, K, and L arrows of FIG. 2.

Since the drive belt 120 moves in a linked state that encircles the middle wall 116 and the guide rails 118-1 and 118-2, the direction in which the moving carriage 121, which has been fastened to the front surface side member 20F of the drive belt 120, moves following the primary scanning direction is opposite to the direction in which the carriage 24, which has been fastened to the back surface side member 20B of the drive belt 20, moves following the primary scanning direction.

If the axis of rotation 156*a* of the cutting head drive motor rotates in the direction of the arrow G, the pulley 154R rotates in the direction of the arrow H. Also, the cutting head 128 moves in the direction of the arrow I in the primary scanning direction on the back surface 116B side of the middle wall 116 together with the movement of the carriage 124 disposed on the back surface side member 120B of the drive belt 120. The moving carriage 121 also moves in the direction of the arrow L following the primary scanning direction on the front surface 116F of the middle wall 116.

If the axis of rotation 156*a* of the cutting head drive motor rotates in the direction of the arrow J, the pulley 154R rotates in the direction of the arrow K. Also, the cutting head 128 moves in the direction of the arrow L in the primary scanning direction on the back surface 116B side of the middle wall 116 together with the movement of the carriage 124 disposed on the back surface side member 120B of the drive belt 120. The moving carriage 121 also moves in the direction of the arrow I following the primary scanning direction on the front surface 116F side of the middle wall 116.

Referring to FIGS. 1 and 2, the carriage 122 is positioned on the right side in the primary scanning direction. In other words, the carriage 122 is in proximity to the side frame 114R. The carriage 124 is positioned on the left side in the primary scanning direction. In other words, the carriage 124 is in proximity to the side frame 114L at the initial state.

In the initial state, the hook 134 and the latching hook 136 are latched, and the carriage 122 is fastened to the side frame 114R. The carriage 124, in the initial state, is positioned in the standard position for moving the carriage the distance L1 in the direction of the arrow L toward the side frame 114L.

Furthermore, when the moving carriage is attached to the front surface side member 120F of the drive belt 120, when the carriages 122 and 124 are in the initial state, the first magnet 142 of the moving carriage 121 and the second magnet 140 attached to the left side wall 122L of the carriage 122 are positioned such that the magnets 142, 140 are spaced apart a distance L2 coinciding with the distance L1.

FIG. 4 is a block diagram illustrating a method for controlling the image creation and cutting system in accordance with one embodiment of the present invention. An image data signal is output from a microcomputer 300. The microcomputer 300 comprises a central processing unit (CPU) 304*a*, and a read only memory (ROM) 304*b*, in which the programs that are executed by the CPU 304*a* are stored. The microcomputer 300 further comprises a random access memory (RAM) 304*c* having buffer memory for temporary storage of the data signals from the host computer 302, and provides a working area for setting registers required to execute programs provided by the CPU 304*a*.

Drivers 308*a*, 308*c*, and 308*d* provide controls for switching on or off respectively the X motor 306, the cutting head drive motor 156, and the actuator 186. Driver 308*e* controls the ink jet head 126. The operating panel 310 comprises a switch for turning power on and off and various kinds of operating keys which are connected through a bus to the CPU 304*a*.

The rotation of the grid roller 132, as shown in FIG. 1, is controlled by the X motor 306 and the driver 308*a*. The sheet 190 is held between the pinch roller 130 and the grid roller 132, as shown in FIG. 1, and moves in the direction of the X-axis (the secondary scanning direction) on the upper surface of the fastening group base member 112. The cutting head drive motor 156 controls the drive belt 120. The driver 308*c* controls the cutting head drive motor 156. The carriage 124, on which the cutting head 128 has been disposed, and the moving carriage 121, are moved in the primary scanning direction, as shown by the arrows G, H, I, J, K, and L in FIG. 2. The cutter holder 174 moves vertically in the direction of the Z-axis using the actuator 86 controlled by the driver 308*d*.

Preferably, in order to create an image on the surface 190*a* of the sheet 190 and to cut the image, an image data signal from the host computer 302 is read and stored in the buffer memory of the RAM 304*c*. The CPU 304*a* then sequentially reads the image data of the RAM 304*c* and determines whether the image data outputted from the host computer 302 is image creation data or cutting data.

If the CPU 304*a* determines that the image data signal outputted from the host computer 302 comprises image creation data, the driver 308*c* activates and controls the cutting head motor 156. The carriage 124 disposed with the cutting head 138 is then moved the distance L1 from the initial state in the direction of the arrow L in the primary scanning direction on the back surface 16B side of middle wall 116, as shown in FIG. 2.

When the carriage 124 moves in the direction of the arrow L and passes through a standard position, such as the initial position described above, the moving carriage 121 moves the distance L2. The distance L2 coincides with the distance L1 on the front surface 116F side of the middle wall 116 in the direction of the arrow I in the primary scanning direction.

Figure 5:
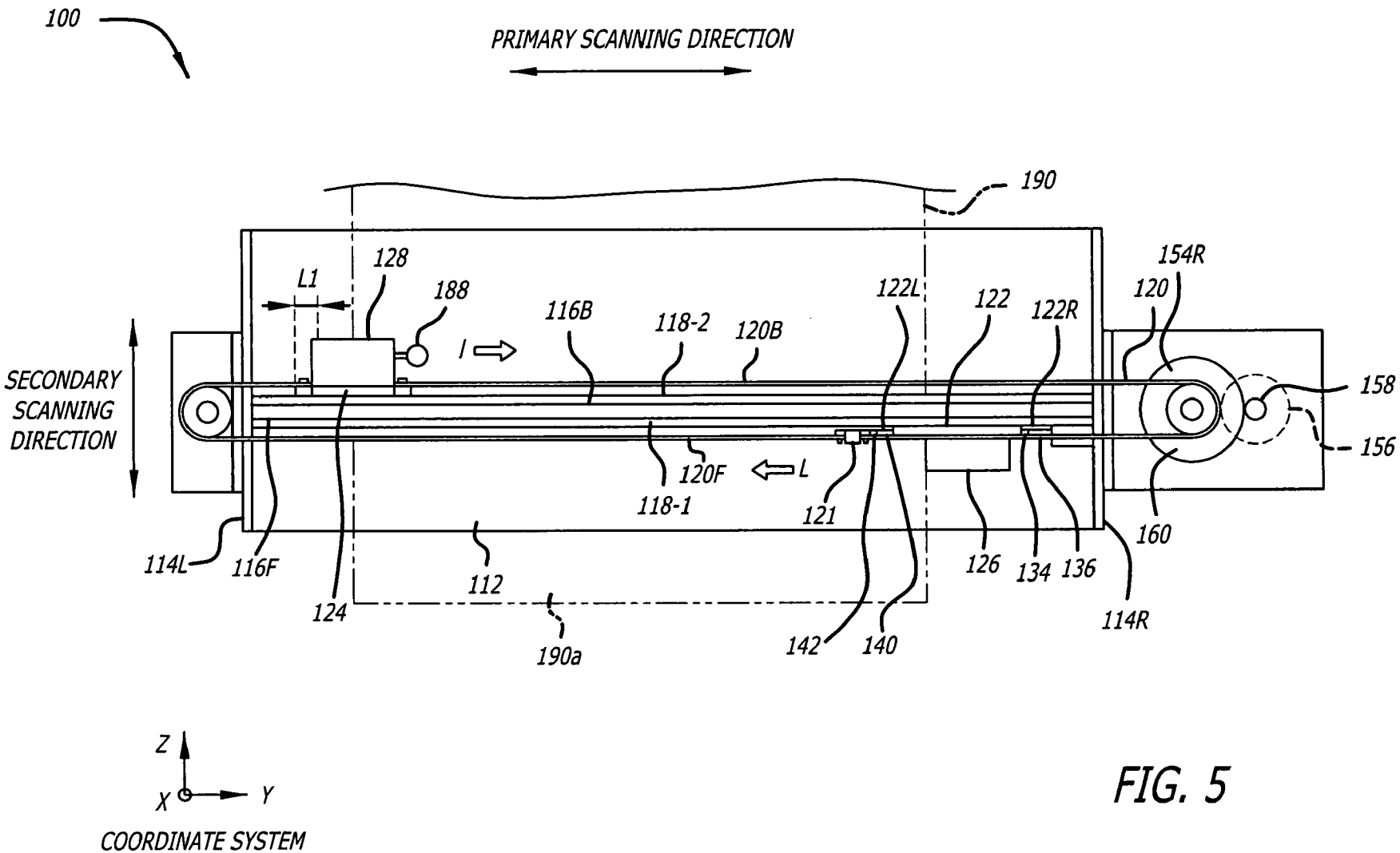
FIG. 5 is a top view depicting a first operational movement of the image creation and cutting system, in accordance with the first embodiment of the present invention.
Figure 6:
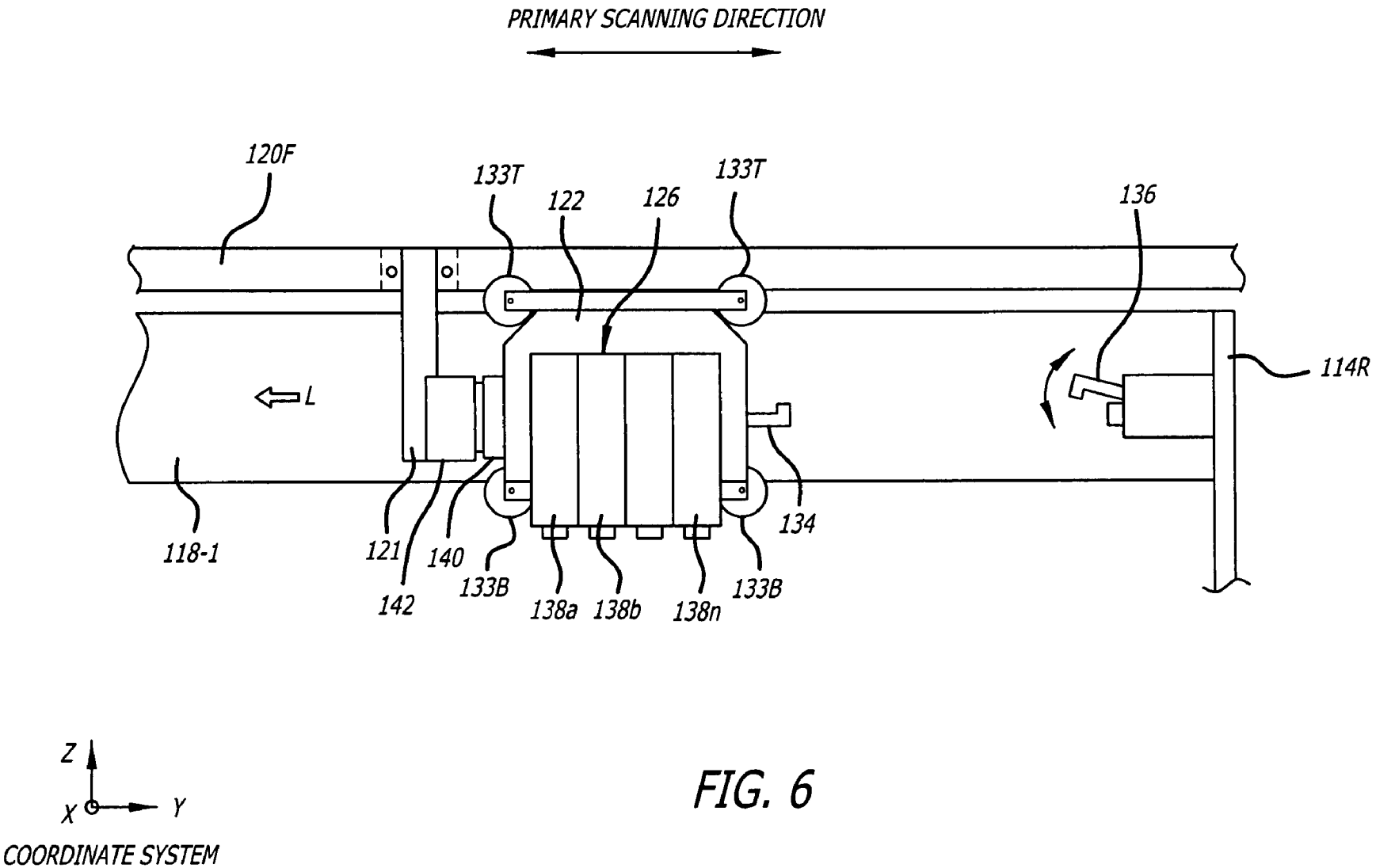
FIG. 6 is a front view illustrating a linked state of a moving carriage and an inkjet head of FIG. 1, in accordance with the first embodiment of the present invention.
Figure 7:
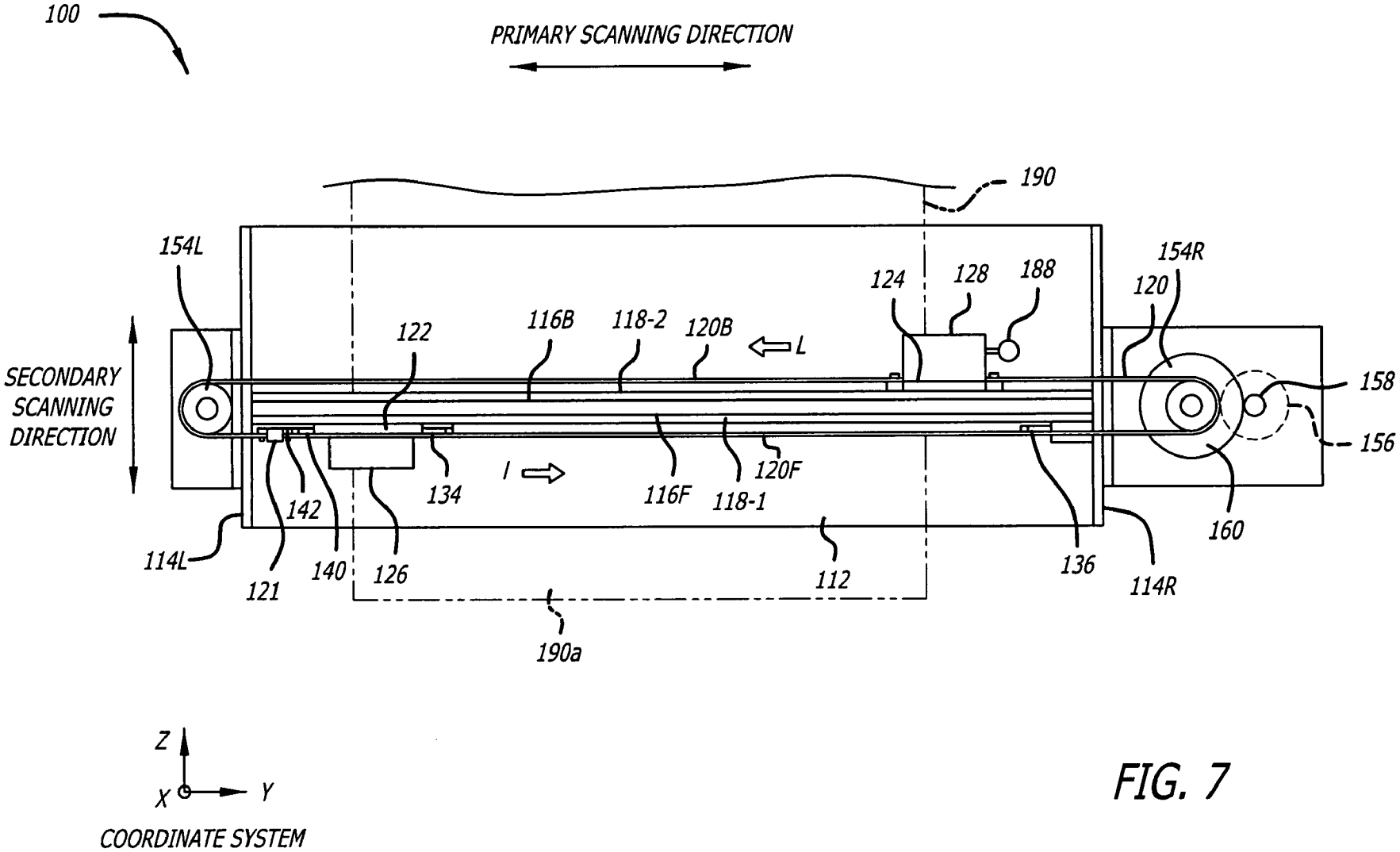
FIG. 7 is a top view illustrating a second operational movement of the image creation and cutting system, in accordance with the first embodiment of the present invention.

FIG. 5 is a top view depicting a first operational movement of the image creation and cutting system in accordance with one embodiment of the present invention. FIG. 6 is a front view illustrating a linked state of the moving carriage and the inkjet head in FIG. 1. FIG. 7 is a top view illustrating an operational movement of the image creation and cutting system in accordance with one embodiment of the present invention.

Referring to FIG. 5, the magnet 142 disposed on moving carriage 121 and the magnet 140 disposed on the left side wall 122L of the carriage 122 are magnetically attracted to each other causing the moving carriage 121 and the inkjet head 26 to be linked together.

The hook 134 and the latching hook 136 are then detached by means of an operating key found on the operating panel 310, as shown in FIG. 4. Also, the side frame 114R is released from the fastener 134, as shown in FIG. 6.

As the carriage 124 moves in the direction of the I arrow, the moving carriage 121 moves in the direction of the L arrow in the primary scanning direction on the front surface 116F side of the middle wall 116. Together with the movement of the moving carriage 121 in the direction of the arrow L, the inkjet head 126 of the carriage 122 on which the magnet 40 is disposed and magnetically attached to the magnet 142 moves as a single unit with the moving carriage 121 in the direction of the arrow L in the primary scanning direction, as shown in FIG. 6.

From the initial state, the inkjet head 216 moves along the L arrow in the primary scanning direction. Then, the inkjet head 126 together with the movement of carriage 124 having the cutting head 126 moves along the L arrow in the primary scanning direction on the back surface 16B side of the middle wall 116, as shown in FIG. 7. The inkjet head 126 moves as a single unit with the moving carriage 124 that moves in the direction of the arrow I in the primary scanning direction from the side frame 114L to the side frame 114R, as shown in FIG. 7.

Therefore, the inkjet head 126 moves back and forth in the primary scanning direction along the guide rail 118-1 as a single unit with the moving carriage 121, which moves in a direction opposite to the direction that the cutting head 28 moves. Additionally, the drivers 308*a*, 308*e* control the X motor 306 in accordance with the image data. Using the image data, the inkjet nozzles 138*a*-138*n* disposed on the inkjet head 126 are selected and the desired image is created on the surface 190*a* of the sheet 190 by the selected inkjet nozzles 138*a*-138*n*.

In other words, when a desired image is created on the sheet 190, the cutting head motor 156 is controlled by the driver 308*c* in accordance with the image data. The drive belt 120 is controlled such that the magnet 142 of the moving carriage 121 and the magnet 140 of the carriage 122 are attached magnetically. Then, together with the movement of the drive belt 20, the carriage 124, on which the cutting head 128 has been disposed, moves back and forth along the guide rail 118-2. The inkjet head 126, disposed on the carriage 122, moves back and forth in the primary scanning direction on the guide rail 118-2 as a single unit with the moving carriage 121 attached with the carriage 124.

However, if the CPU 304*a* determines the image data signal comprises cutting data, the driving of the cutting head motor 156 is controlled by the driver 308*c*. The carriage 124, disposed with the cutting head 128, moves the distance L1 from the initial state along the L arrow in the primary scanning direction on the back surface 116B side of middle wall 116, as shown if FIG. 2.

When the carriage 124 is moved along the L arrow and passes through the standard position, the moving carriage 21 moves the distance L2. The distance L2 coincides with the moved distance L1 on the front surface 116F side of the middle wall 116 in the direction of the arrow I in the primary scanning direction.

The magnet 142 of the moving carriage 121 and the magnet 140 of the carriage 122 attract one another. Thus, the carriage 122 disposed with the inkjet head 126 moves as a single unit with the moving carriage 121 in proximity to the side frame 114R, as shown in FIG. 5. Afterwards, the hook 134 of the carriage 122 is latched to the latching hook 136 of the side frame 114 by an operating key provided by the operating panel 310, as shown in FIG. 4. The carriage 122, on which the inkjet head 126 is disposed, is then fastened to the side frame 114R.

Referring to FIGS. 5 and 8, the carriage 124 is moved in the direction of the arrow I and together with the movement of the carriage 124, the moving carriage 121 moves in the direction of the arrow L in the primary scanning direction on the front surface 116F of the middle wall 116. Because the holding force of the locked state in which the hook 134 and the latching hook 136 are latched is greater than the magnetic attachment force linking the magnets 140, 142 that link the inkjet head 126 and the moving carriage 122, the magnets 140, 142 are pulled apart. The carriage 122 on which the inkjet head is disposed is separated from the moving carriage 121, as shown in FIG. 8.

The drivers 308*a*, 308*c*, and 308*d* provide control information, in accordance with the image data, for driving the X motor 306, the cutting head drive motor 156, and the actuator 186. As such, it is possible to cut the sheet 190 with a blade 188*a* of the cutting head 128.

Where the sheet 190 is to be cut in the form of a desired image, the driver 308*c* controls the cutting head drive motor 156 in accordance with the image data. The control is done such that the magnet of the moving carriage 121 and the magnet 140 of the carriage 122 are not magnetically attached by the driving of the drive belt 120. Together with the movement of the drive belt 120, the carriage 124, disposed with the cutting head 128, moves from the initial state toward the side frame 114R in the primary scanning direction, and returns to the initial state.

The carriage 124 moves in the direction of the arrow I in the primary scanning direction on the back surface 116B side of the middle wall 116 from the standard position, such as the initial position. After, the carriage 124 moves in the direction of the arrow L from the side frame 114R. Upon the carriage 124 returning to the standard position, the movement stops and the carriage 124 does not pass through the standard position.

On the front surface 116F of the middle wall 116, the moving carriage 121 moves such that the interval between the magnet 142 of the moving carriage 121 and the magnet 140 of the carriage 122 is the distance L2, as shown in FIG. 2, and magnetic attachment of the magnets 142, 140 is avoided. Also, the carriage 122 is fastened to the side frame 114R by the latching of the hook 134 and the latching hook 136. Upon instructions that an image is to be cut from the sheet 190, the inkjet head 126 is prohibited from moving with the cutting head 128.

As explained above, the inkjet head 126 on the carriage 122 is slidably mounted on the guide rail 118-1. The cutting head 128 on the carriage 124 is slidably mounted on the guide rail 118-2. Furthermore, movement of the moving carriage 121 is arranged such that it moves together with the movement of the cutting head 128 due to the drive belt 120. The same drive system provides movement control of the cutting head 128 and the moving carriage 121.

When an image is created in response to the image data from the host computer 202, the moving carriage 121 and the inkjet head 126 are linked. In this case, the cutting head 128, and the inkjet head 126 move as a single unit with the cutting head to create the image. Also, when a cutting operation is carried out in response to the image data, the inkjet head 126 is detached from the moving carriage 121 and fastened to the side rail 114R. Thus, the cutting head 128 may be separately driven and carry out the cutting process along an outline of the image.

The image creation and cutting system 100 is configured to have a single drive section that carries out the movement control of both the inkjet head 126 and the cutting head 128. For example, the inkjet head 126 is moved in those cases where an image is created on the surface 100*a* of the sheet 190, and the cutting head is moved in those cases where the cutting of the image on the sheet 190 is carried out. Because of this, the configuration of the present invention is simplified and the number of components is reduced, thus reducing costs.

Additionally, because the two heads—the inkjet head 126 and the cutting head 128—move by means of a single drive system, a discrepancy between the image and the cutting line caused by varying factors is not produced and unnecessary adjustment and management are not required. The varying factors may include errors associated with accuracy of the movement distance for each of the groups of components, such as cutting head 128 and the inkjet head 126 and the like. Therefore, it is possible to fully deal with complicated and high accuracy control when printing at a high resolution, and the like, is required. High quality printing and cutting results can be obtained. Thus, the present invention is useful as both an inkjet printer that carries out high resolution printing and as a system in which a cutting capability has been installed in addition to the printing capability.

Preferably, in a preferred embodiment, the microcomputer 300 determines whether the image data signal by the host computer 302 comprises image creation data or cutting data. However, naturally, the system is not limited to a computer 302, but may be replaced by similar control devices.

The system appropriately changes the contents and the like of the image data that are used for operations in the image creation and cutting system 10 in accordance with the present invention. In one example, the image creation and cutting system 100 may be set up such that only one set or the other of the image creation data or the cutting data is required to be input for each process or such that the required data is extracted from the image data.

In another embodiment, a plurality of inkjet nozzles 138*a*-138*n* are arranged on the inkjet head 126. However, the system is not limited to this arrangement. A single inkjet nozzle may be disposed on the inkjet head 126 in those cases where the image creation is carried out in a single color.

Various kinds of ink can be employed for the ink that is sprayed from the inkjet nozzles of the inkjet head 126. For example, inks such as those that are set by irradiated light on the sheet or that have thickening properties may be used.

In another embodiment, the inkjet head 126 for printing is arranged on the carriage 122 and the cutting head 128 for cutting is arranged on the carriage 124. However, the system 100 is not limited to this. The system may be set up such that various kinds of systems such as a inkjet head with which printing that is different from an inkjet format is possible. This includes, for example, a inkjet head that uses a thermal transfer method, and a suitable cutting head that is used for cutting, such as clipping and the like, are arranged respectively on the carriages 122 and 124. In addition, the system 100 may also be set up such that a configuration is added to obtain a high quality printing or cutting result.

For example, a configuration may be added where the inkjet head 126 that carries out the image creation may be arranged so that when the carriage 122 is positioned and stands by on the side frame 114R in the initial state, a cap may be attached to cover the inkjet nozzles 138*a*-138*n*. If done in this manner, the inkjet nozzles 138*a*-138*n* would be protected in a standby mode, which would prevent hardening of ink, adhesion of dirt, and the like on the nozzles. This option makes possible even better printing results.

The cutter holder 174, as shown in FIG. 4, on the cutting head 128 that is disposed on the carriage 124, may be modified to a pen holder. The pen holder may retain a pen such as an ink pen, a sign pen, a ball pen, a pencil, or the like, and create an image based on the image data signal.

Also, the cutter 188 disposed on the cutting head 128 may also be changed. For example, the cutter 188, in FIG. 1, is positioned on the right side of the cutting head 128. If the cutter 188 were moved to the left side, the position of the cutter 188, in the initial state, would become a position that is more in proximity to the side frame 114L than the state shown in FIG. 1. This alternative configuration may enlarge the W3 region which is the print processing region, as shown in FIG. 2.

Figure 9:
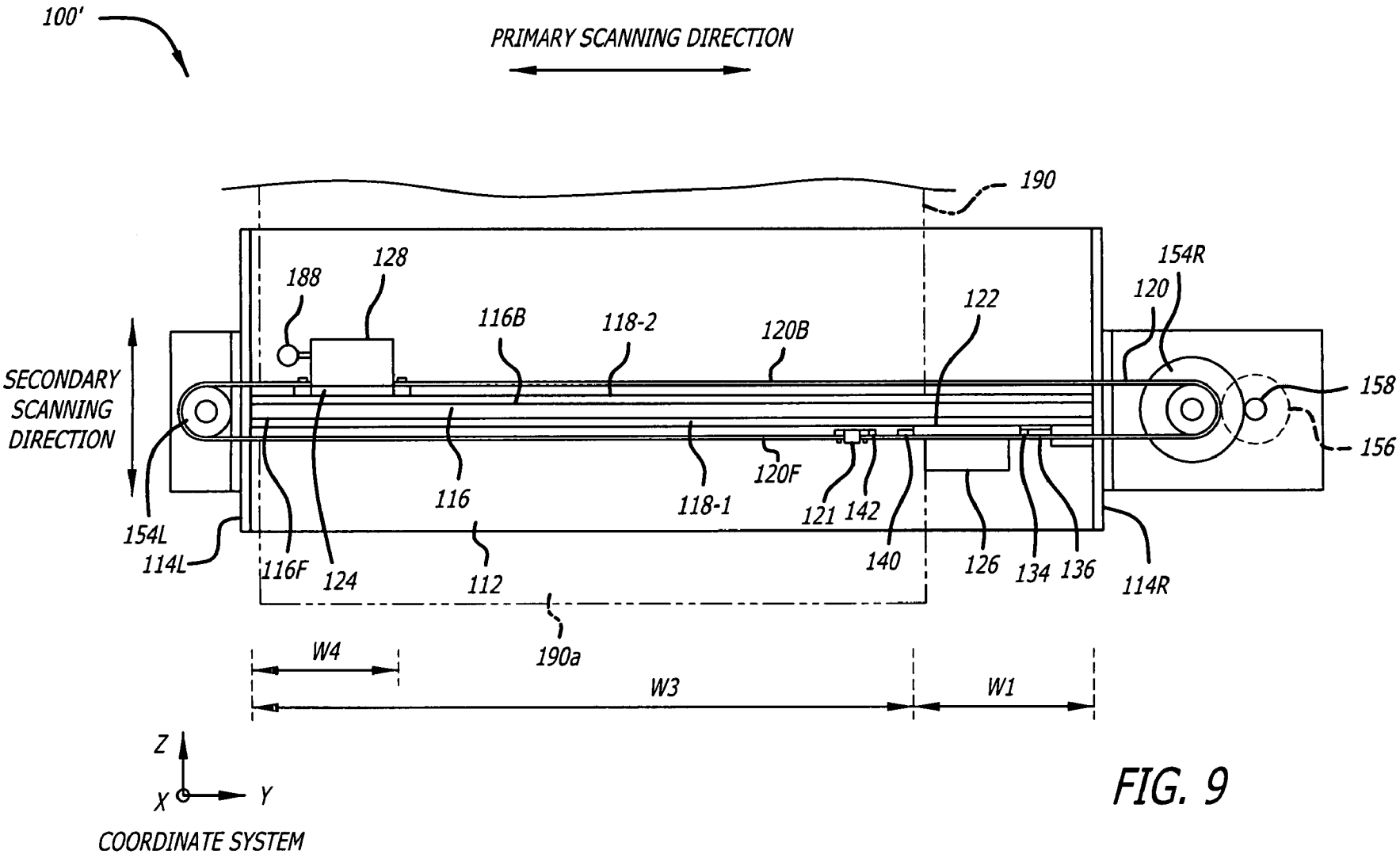
FIG. 9 is a top view illustrating a connected state of the moving carriage and the inkjet head of FIG. 1, in accordance with the first embodiment of the present invention.

Referring to FIG. 2, the region W1 in which the inkjet head 126 stands by and the W2 region in which the cutting head 128 stands by in the initial state, are set so that the regions are positioned on both the left and right ends in the primary scanning direction of the printing processing W3 region. In the alternative, if the system is configured, as shown in FIG. 9, in the initial state, the region in which the cutting head 128 stands by overlaps the printing processing W3 region in the secondary scanning direction, as shown in FIG. 9 of the W4 region. As compared to the image creation and cutting system 100 shown in FIGS. 1, 2, the overall length of the image creation and cutting system 100', as shown in FIG. 9, may be shortened in the primary scanning direction to achieve a miniaturized system without making the printing processing region shorter.

In another embodiment, the initial state of the system 100 may be set to any state desired. It is also possible to select and set the speed of the movement of the carriages 122 and 124, and the moving carriage 121 for each output.

The implementation of the control method shown in FIG. 5 is suitable for use, in those cases, where a stepping motor has been employed for the X motor 306, the inkjet head drive motor 140, the cutting head drive motor 156, and the actuator 186. Alternatively, a servo-motor may be utilized. Various modifications may be made to the configuration. For example, the states of the X motor 306, the inkjet head drive motor 140, the cutting head drive motor 156, and the actuator 186 may be detected, and the positions of the carriages 122, 124, with respect to the sheet 190, may be read through the CPU 304*a* and stored in RAM 304*c*.

In another embodiment, the guide rails 118-1, 118-2 are arranged on the front surface 116F and the back surface 116B of the middle wall 116. However, the system is not limited to this arrangement. The system may also be set up such that, for example, only the guide rails are arranged extending in any direction with the center wall 116 removed as long as the two guide rails are arranged without spatially intersecting.

In another embodiment, the fastening section is configured using the hook 134 and the latching hook 136 and the linking section is configured using the magnet 140 and the magnet 142. However, the system may be modified. For example, a configuration is possible for the latching to be done in a pin form, using magnetic bodies having various forms, or fitting by means of the load at the time that the other side moves. In yet another example, attachment and detachment are possible by means of a driving force of various kinds of driving sources, such as a solenoid and the like, as the configuration of the fastening section or the linking section.

In addition, as in the case of the moving carriage 121', as shown in FIGS. 10(*a*) and (*b*), the item may be made comprising entirely of sheet metal, the bottom 121'*c* side of the moving carriage 121' being bent into an "L" shape, and the linking member 21'*d* being formed. When modified in this manner, the linking member 121'*d* of the moving carriage 121' becomes a magnetic attachment body that is attached to the magnet 140 due to the magnetic force of the magnet 140 on the left side wall 122L of the carriage 122 without a magnet on the moving carriage 121'. Thus, the moving carriage 121' may be linked or detached with a simple configuration.

In contrast to FIGS. 10(*a*) and (*b*), the magnet 140 may not be disposed on the carriage 122 and the left side wall 122L is formed of sheet metal. Here, it is possible to configure the present invention such that the appropriate linking to and detachment from the moving carriage 121 utilizes magnet the 142. Preferably, the magnet 142 and the magnetic attachment body attached to the magnet may each be magnetically arranged alternatively on the carriage 122 of the ink jet head 126 or the moving carriage 121 or 121'.

In addition, in the preferred embodiment described above, the latching and detaching operations of the hook 134 and the latching hook 136 are carried out by means of the operating key disposed on the operating panel 310, as shown in FIG. 4. However, these operations may also be configured so that the latching and detaching are carried out automatically at a specified time and the operation of the linking section can also be modified in conformance with the configuration.

Also, the configuration of the fastening section or the linking section as well as the configuration of the head for printing may be set up so that the head for printing moves as a single unit with the cutting head 128 in those cases when an image on the sheet 190 is being cut.

In a preferred embodiment, a configuration has been made in which the moving carriage 121 and the carriage 124 on which the cutting head 128 has been arranged are fastened to the drive belt 210, and the carriage 122, on which the inkjet head 126 has been arranged, is free with respect to the drive belt 120. However, the system is not limited to this arrangement.

For example, a configuration may be set in which both the cutting head for cutting or the inkjet head for printing is fastened to the drive belt and the like. In another example, a configuration is possible in which both the cutting head and the inkjet head move freely, or alternatively, in which the cutting head is free and the inkjet head is fastened.

Appropriate modifications may also be made in conformance with the type of head that is used as the cutting head, or the type of head that is used as the inkjet head and the like. The moveable inkjet head may be synchronized with the movement of the cutting head on the back surface side of the cutting head. Alternatively, the carriage 124 on which the cutting head 128 is disposed and the carriage 122 on which the inkjet head 126 is disposed may be transposed. In this modified configuration, the cutting head is free and the inkjet head is fixed.

In another embodiment, the moving carriage 121 is fixed to the drive belt 120 using screws 119, 123. However, the moving carriage 121 may be attached to a specified position on the drive belt 120 using various attachment configurations.

The moving carriage 121, may alternatively, be supported by a direct drive bearing, or supported so that sliding is possible by using the guide rollers 133T, 133B of the carriage 122.

Figure 11:
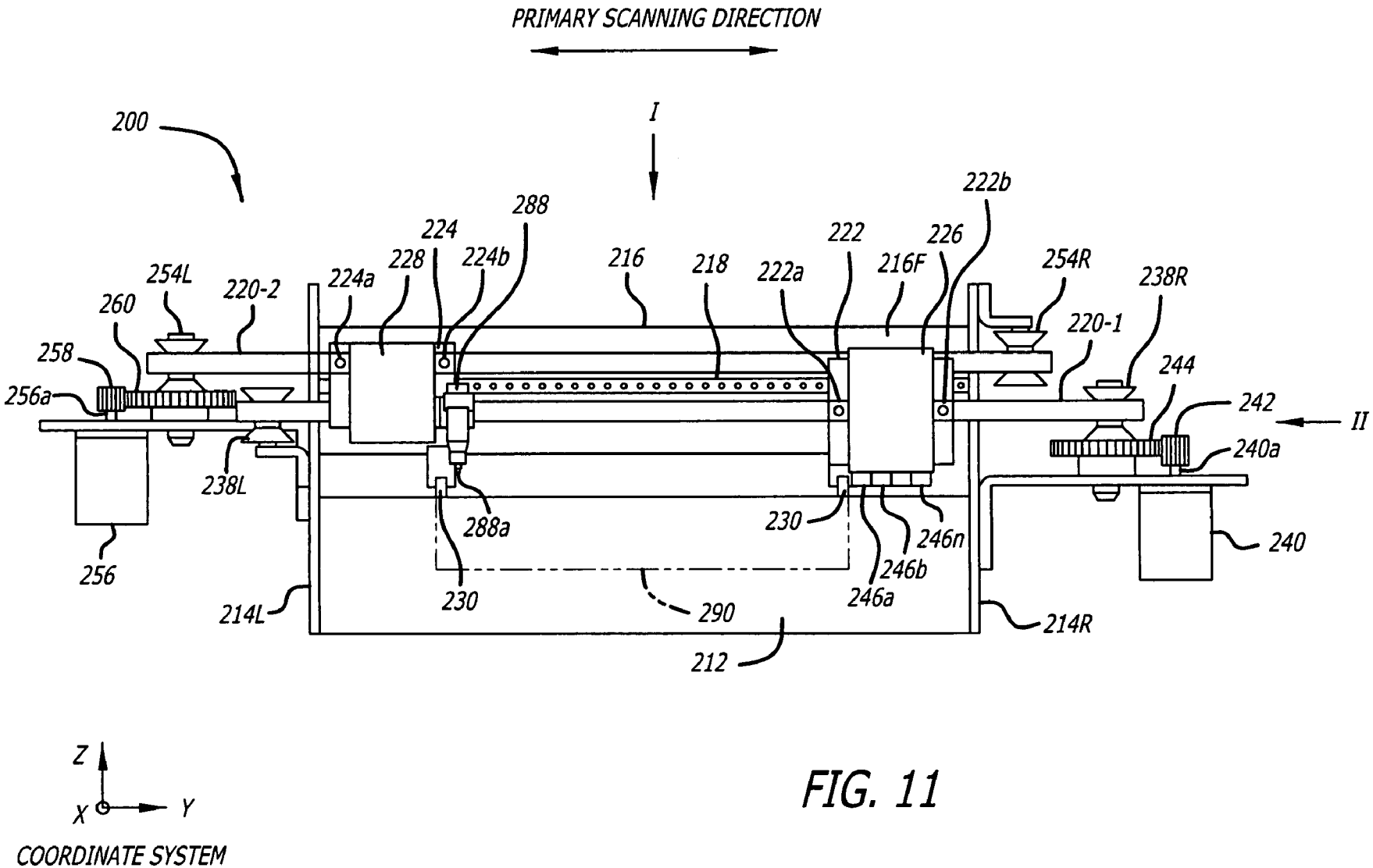
FIG. 11 is a front view illustrating the image creation and cutting system, in accordance with a second embodiment of the present invention.

FIG. 11 is a front view illustrating the image creation and cutting system in accordance with a second embodiment of the present invention. Referring to FIG. 11, a fastening group base member 212 is extended in the primary scanning direction. The side frames 214L, 214R are arranged perpendicular to the fastening group base member 212 on the left and right sides of the fastening group base member 212. A middle wall 116 is provided that is linked to the left and right side frames 214L, 214R. A single guide rail 218 is arranged extending in the primary scanning direction on the front surface 216F of the middle wall 216.

Drive belts 220-1, 220-2 are arranged parallel to the front surface 216F of the middle wall 216 so that the belts are free to move in the primary scanning direction. A carriage 222 is fastened to the drive belt 220-1 and mounted so that the carriage 222 freely slides on the guide rail 218. A carriage 224 is fastened to the drive belt 220-2 and mounted so that the carriage 224 slides freely on the guide rail 218. An inkjet head 226 is disposed on the carriage 222 so as to face opposite the sheet 290 on the fastening group base member 212. A cutting head 228 is provided on the carriage 224 for facing opposite the sheet 290 on the fastening group base member 212. The inkjet head 226 has a plurality of inkjet nozzles 246*a*, 246*b*, . . . , 246*n*. Various colored inks are supplied to each of these inkjet nozzles 246*a*-246*n* from ink tanks.

Figure 12:
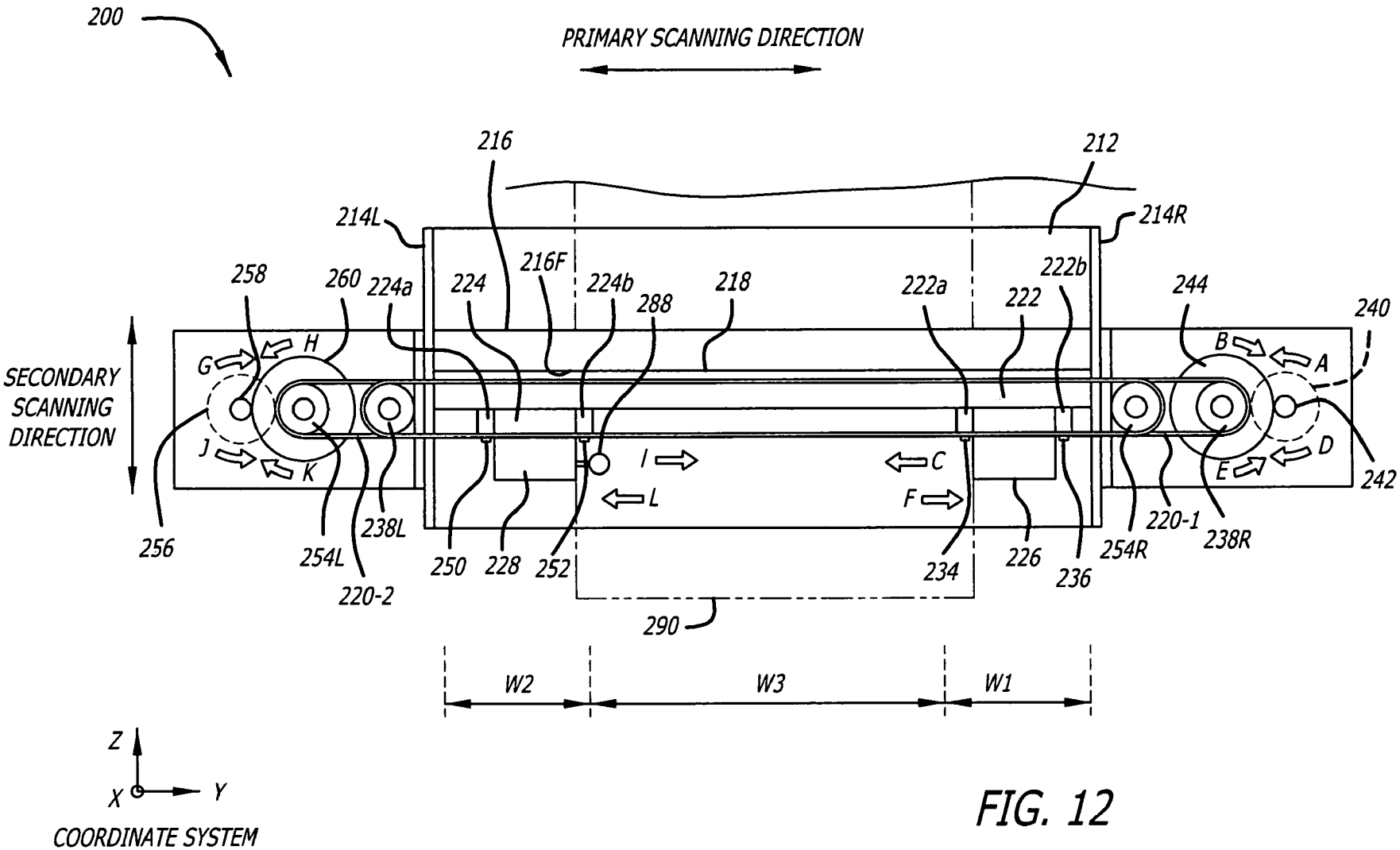
FIG. 12 is a partial top view of FIG. 11, in accordance with the second embodiment of the present invention.
Figure 13:
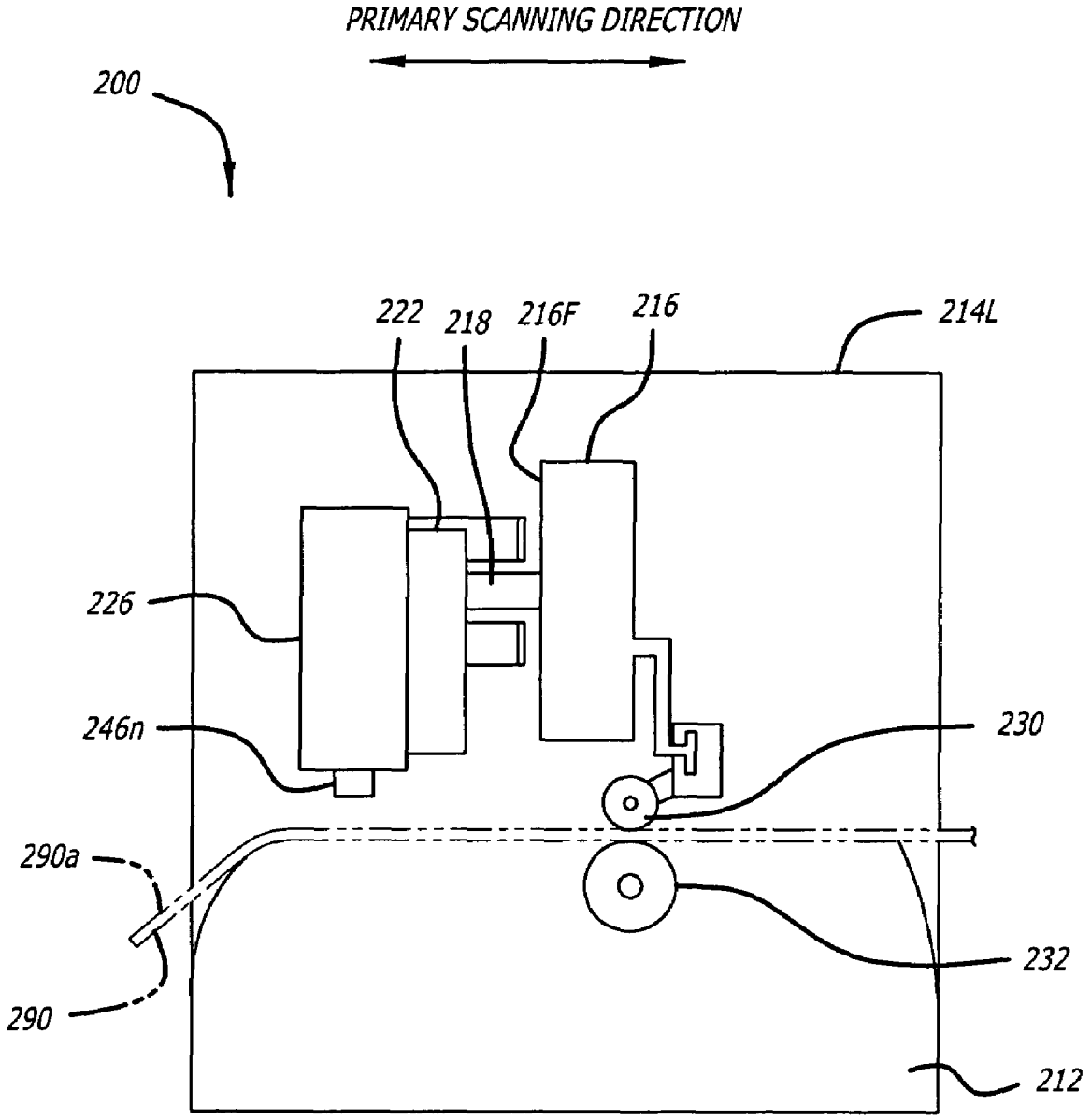
FIG. 13 is a partial side view illustrating the cutting head connection of FIG. 11, in accordance with the second embodiment of the present invention.
Figure 13:
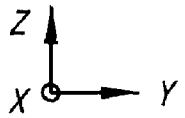
Figure 14A:
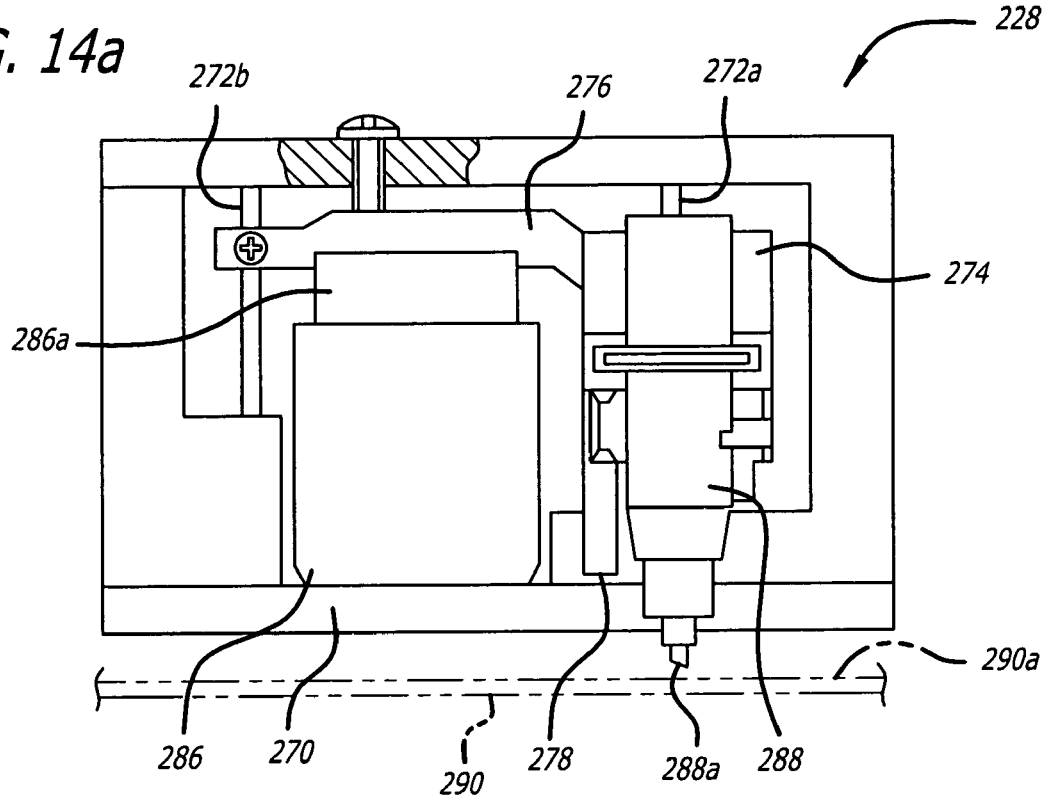
FIG. 14*a* is a front view illustrating the cutting head, in accordance with the second embodiment of the present invention.
Figure 14B:
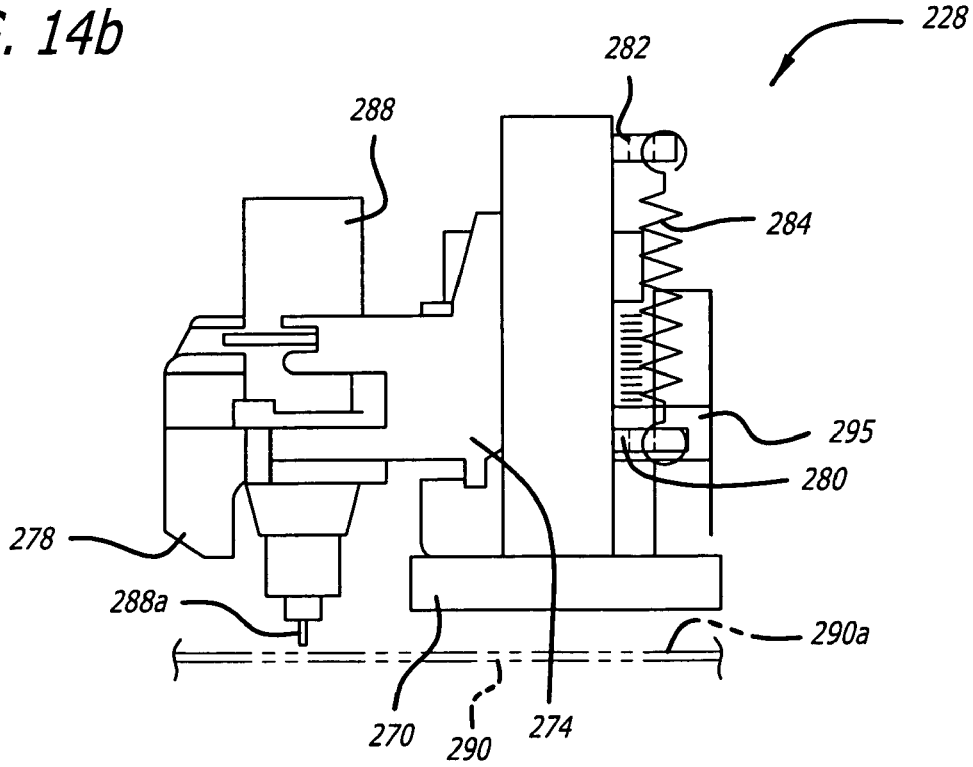
FIG. 14*b* is a side view illustrating the cutting head, in accordance with the second embodiment of the present invention.

FIG. 12 is a partial top view of FIG. 11. FIG. 13 is a partial side view illustrating the cutting head connection of FIG. 11. The key 230 is a pinch roller that has been disposed above the fastening group base member 212 and presses the sheet 290 onto the fastening group base member 212. The sheet 290 is held between the pinch roller and the grid roller 232, as shown in FIG. 13, and disposed below the fastening group base member 212. When a stepping motor rotates the grid roller 232, the sheet 290 is fed in the secondary scanning direction, i.e., along the X-axis.

Figure 15:
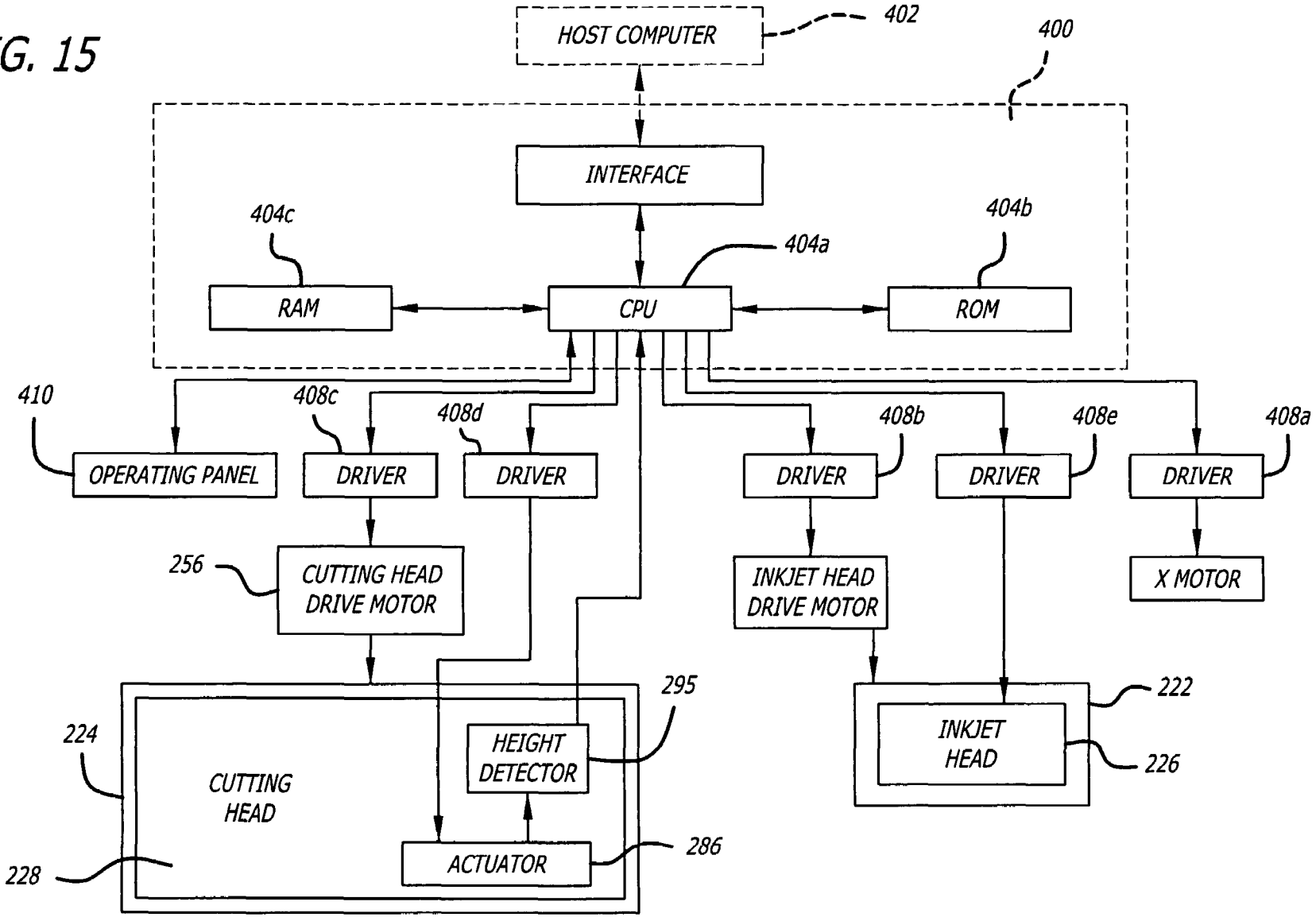
FIG. 15 is a block diagram illustrating a method for controlling the image creating and cutting system, in accordance with the second embodiment of the present invention.

An operating panel 410, as shown in FIG. 15, controls the overall operation and the instruction for the processes. A display section outputs operating states. A cursor key specifies the position of the inkjet head 226 and the cutting head 228. A start region setting key designates the region that the specified member should start creation or cutting of the image in response to an image data signal. The creation start key starts the creation or the cutting of the image from the start region.

The carriage 222 is supported for moving the inkjet head 226 in the primary scanning direction, i.e., the Y-axis direction, on the guide rail 218. Ends of the drive belt 220-1, by means of the screws 234, 236, connect respectively to the attachment sections 222*a*, 222*b* provided on both the left and right end sections of the carriage 222. The drive belt 220-1, which the carriage 222 has been fastened, couples between the pulley 238L, which is disposed on the side frame 214L side, and the pulley 238R, which is disposed on the side frame 214R, parallel to the front surface 216F of the middle wall 216.

The inkjet head drive motor 240 is disposed on the side frame 214R. The motor gear 242 couples to the axis of rotation 240*a* of the motor 240. The motor gear 242 meshes with the gear 244 disposed on the same shaft as the pulley 238R.

An inkjet head drive motor 240 causes rotation of the axis of rotation 240*a* and transmits, through the motor gear 242 and the gear 244, a rotational drive force to the pulley 238R. The pulley 238R causes movement of the drive belt 220-1, which causes the carriage 223 to move in the primary scanning direction on the guide rail 218.

In the case where the axis of rotation 240*a* of the inkjet head drive motor 240 rotates along the A arrow, the pulley 238R rotates along the B arrow and the carriage 222, which is disposed on the drive belt 220-1, moves along the C arrow in the primary scanning direction. As a result, the inkjet head 226 on the carriage 222 moves in the primary scanning direction along the front surface 216F of the middle wall 216 from the side frame 214R to the side frame 214L.

In the case where the axis of rotation 240*a* of the inkjet head drive motor 240 rotates along the D arrow, the pulley 238R rotates along the E arrow and the carriage 222, which is disposed on the drive belt 220-1, moves in the primary scanning direction along the F arrow. As a result, the inkjet head 226 on the carriage 222 moves in the primary scanning direction along the front surface 216F of the middle wall 216 from the side frame 214L to the side frame 214R.

The carriage 222 slidably mounted on the guide rail 218 moves in response to the drive belt 220-1. The inkjet nozzles 246*a*-246*n*, on the inkjet head 226, are then selected based on the image data signal. Colored ink is then sprayed from the selected nozzles of the inkjet nozzles 246*a*-246*n* to create a color image on the surface 290*a* of the sheet 290.

The carriage 224 is supported so that it is possible for the cutting head to move in the primary scanning direction on the guide rail 218. The ends of the drive belt 220-2 are screwed onto the attachment sections 224*a*, 224*b* on both the left and right ends of the carriage 224 by means of the screws 250, 252.

The drive belt 220-2 is attached to the carriage 224 and connected between the pulley 254L disposed on the side frame 214L, and the pulley 254R disposed on the side frame 214R, which is arranged in parallel with the front surface 216F of the middle wall 216.

The drive belt 220-1 and the drive belt 220-2, which are located in parallel with the front surface 216F, are positioned at different heights along the Z-axis. The drive belt 220-1 is positioned below the guide rail 218 while the drive belt 220-2 is positioned above the guide belt 218.

A cutting head drive motor 256 is arranged on the side frame 214L. A motor gear 258 is located on the axis of rotation of the motor 256. A gear 260 is located on the same axis as the pulley 254L and is meshed with the motor gear 258.

The cutting head drive motor 256 causes rotation of the axis of rotation 256*a* and transmits, through the motor gear 258 and the gear 260, a rotational drive force to the pulley 254L for driving the cutting head. The pulley 254L causes movement of the drive belt 220-2, which causes the carriage 24 to move in the primary scanning direction on the guide rail 218.

Where the axis of rotation 256*a* of the cutting head drive motor 256 rotates in the direction of the G arrow, the pulley 254L rotates along the H arrow, and the carriage 224, on the drive belt 220-2, moves along the I arrow in the primary scanning direction. Thus, the cutting head 228 located on the carriage 224 moves in the primary scanning direction on the front surface 216F from the side frame 214L to the side frame 214R.

Alternatively, when the axis of rotation 256*a* of the cutting head drive motor 256 rotates along the J arrow, the pulley 254L rotates along the K arrow and the carriage 224, disposed on the drive belt 220-2, moves in the primary scanning direction along the L arrow. As a result, the cutting head 228 on the carriage 224 moves in the primary scanning direction along the front surface 216F from the side frame 214R to the side frame 214L.

The cutting head 228 moving in the primary scanning direction together with the carriage 224 will now be described. The carriage 224 is mounted so that the carriage is free to slide on the guide rail 218, by means of the drive belt 220-2 being driven, as shown in FIGS. 11, 12, 13 and 14*a*-14*b*.

The cutting head 228 is furnished with a frame shaped carriage base 270. Guide rods 272*a*, 272*b* that extend vertically are disposed in parallel on the left and right sides 214L, 214R. A cutter holder 274 is attached to the guide rods 272*a*, 272*b* in a state in which the holder is free to move vertically.

The cutter holder 274 comprises two pen retention sections 278, which possess catching and holding claws, that are disposed protruding from one end of the rear section 276 that has been attached to the guide rods 272*a*, 272*b* toward the front. The cutter holder 274 is pulled upward by a coil spring 284, wherein the coil spring 284 is suspended across a hooking piece 280 protruding on one end rear section of the cutter holder 274 and on the top of one end rear section of the carriage base 270.

A key 286 is an actuator arranged on the bottom section of the carriage base 270 and linked with an upper moving section 286*a* to a rear section 276 of the cutter holder 274. The actuator causes contraction of the coil spring 284 for moving the cutter holder 274 upward. The actuator may also cause the coil spring 284 to elongate for moving the cutter holder 274 downward.

A key 288 is a cutter that is held in the pen retention section 78 of the cutter holder 274. A cutter blade is installed in a tip section so that the blade 288*a* may be replaced. A key 290 is a height detection device that operates the actuator 286. The actuator 286 may move the cutter holder 274 from a stopped position and bring the cutter blade 288*a* into contact with the surface 290*a* of the sheet 100. The cutter blade 288*a* may be a swivel knife type, rotating type, and the like. Ordinary cutting instruments, ultrasonic cutters, heat cutters that use heat, and the like may also be employed for the cutter blade.

FIG. 15 is a block diagram illustrating a method for controlling the image creating and cutting system in accordance with one embodiment of the present invention. The structural elements described below are shown in FIGS. 11-12.

Overall operation of the image creation and cutting system 200 is controlled by means of an image data signal that is outputted from a microcomputer 400. The microcomputer 400 comprises a central processing unit (CPU) 404*a* and a read only memory (ROM) 404*b* in which the programs that are executed by the CPU 404*a* are stored. The microcomputer 400 further comprises a random access memory (RAM) 404*c* having a buffer memory for temporarily storing the image data signals from a host computer 402. The buffer memory is also the working area in which various kinds of registers that are required at the time of the execution of the programs by the CPU 404*a* are set.

Drivers 408*a*, 408*b*, 408*c*, and 408*d* which control an X motor 406, an inkjet head drive motor 240, a cutting head drive motor 256, and the actuator 286, a driver 408*e* which controls the ink jet head 226, and an operating panel 410 which includes a switch for turning power on and off and various kinds of operating keys are all connected through a system bus to the CPU 404*a*.

The rotation of the grid roller 232 is controlled by the X motor 406, which is controlled by the driver 408*a*. The sheet 290 is held between the pinch roller 230 and the grid roller 232, as shown in FIG. 13, as the sheet 290 moves along the secondary scanning direction in the X direction along the upper surface of the fastening group base member 212. The carriage 222, on which the ink jet head 226 is disposed, is moved by the injector head drive motor 240, which is controlled by the driver 408*b*, in the primary scanning direction on the guide rail 218. The A, B, C, D, E, and F arrows pictorially represent movement of the carriage 222, as shown in FIG. 12. The cutting head drive motor 256 moves the carriage 224 attached to the cutting head 228. The cutting head drive motor 256 is controlled by the driver 208*c* for movement in the primary scanning direction on the guide rail 218 (referring to the G, H, I, J, K, and L arrows, as shown in FIG. 12). In addition, the cutter holder 274 is controlled by the actuator 286 having control signals provided by the driver 408*d* for vertical movement along the Z-axis.

Referring to FIGS. 11-12, the initial state of the carriage 222 is proximal to the side frame 214R in the primary scanning direction and the initial state of the carriage 224 is proximal to the side frame 214L on the leftmost side in the primary scanning direction.

In the above configuration, an image is created on the surface 100*a* of the sheet 290 and an outline of the image is cut using the image creation and cutting system 200. The image data from the host computer 402 is read and stored in the buffer memory of the RAM 404*c*. The CPU 404*a* sequentially reads the image data of the RAM 404*c* and performs processing to determine whether the image data is image creation data or cutting data.

If it is determined by the CPU 404*a* that the image data comprises image creation data, the drivers 408*a*, 408*b*, and 408*e* control the X motor 406 and the inkjet head motor 240 in accordance with the image data. Inkjet nozzles 246*a*-246*n*, disposed on the inkjet head 226, are then selected. The image is then created on the surface 290*a* of the sheet 290 by means of the selected inkjet nozzles 246*a*-246*n*.

In summary, when an image is created on the sheet 290, the driving of the injector drive motor 240 is controlled-on by the driver 408*b* in accordance with the image data. The carriage 222, on which the ink jet head 226 is disposed, moves toward the side frame 214L from the initial state in the primary scanning direction, and returns to the initial state from the side frame 214L. Simultaneously, the driving of the cutting head drive motor 256 is controlled-off. Thus, the carriage 224, on which the cutting head 228 is disposed, stands by in an initial state proximal to the side frame 214L, without movement in the primary scanning direction.

If the CPU 404*a* determines that the image data comprises cutting data, the drivers 408*a*, 408*c*, and 408*d* control the X motor 406, and the cutting head drive motor 256 in accordance with the image data. The actuator 286 is driven to cut the sheet 290 using the cutter blade 288*a*.

In summary, where the sheet 290 is cut along the outline of the image, the cutting head motor is driven by the driver 408*c* in accordance with the image data. The carriage 224, on which the cutting head 228 is disposed, moves toward the side frame 214R from the initial state in the primary scanning direction, and returns to the initial state from the side frame 214R. Simultaneously, the driving of the inkjet head drive motor 240 is controlled-off. Thus, the carriage 222, on which the ink jet head 226 is disposed, stands by in the initial state proximal to the side frame 214R without moving in the primary scanning direction.

The ink jet head 226 is attached on the carriage 222, which is mounted on the single guide rail 218, so that the carriage 224 slides freely in the primary scanning direction on the guide rail 218 together with the carriage 222. The drive belt 220-1 provides the driving force for the inkjet head drive motor 240. The cutting head 228, which is positioned on the carriage 224, is slidably mounted on the single guide rail 218 for movement in the primary scanning direction on the guide rail 218. The drive belt 220-2 provides the driving force for the cutting head drive motor 256. By means of this image creation and cutting system 200, individual movement of the ink jet head 226 is used for image creation. The cutting head 228, that cuts the image outline and the like, is mounted on the guide rail 218, for movement in any direction on the guide rail 218 by means of a drive system separate from that of the ink jet head 226.

A separate drive system makes it possible to have only the inkjet head 226 move in cases where an image is to be created on the surface 290*a* of the sheet 290, and to have only the cutting head 228 move in cases where the cutting of the image on the sheet 290 is carried out.

By means of the present invention, in the respective processes of printing and cutting, only the inkjet head 226 or the cutting head 228 moves along the guide rail 218 which is arranged at a right angle to the direction of sheet 290 advance. The one head that moves may be lightweight, allowing high speed operation utilizing simplified controls. As a result, the image creation and image cutting may be performed at a high speed, and the time that is consumed by both the printing and the cutting may be shortened. Thus, an increased throughput image creating and cutting system may be achieved.

By means of the present invention, only one head is required to be driven for that process. Thus, controls are only necessary for driving one head in a single process, either printing or cutting. For example, the control of the ink jet head 226 and the cutting head 228 are set up so that each head is independently controlled. Thus, the complicated and high-accuracy control required for printing high resolution images may be handled satisfactorily, and a high quality printing result and cutting process may be achieved.

In a preferred embodiment, the microcomputer 400 determines whether the image data from the host computer 402 comprises image creation data or cutting data. However, the system is not limited to this. The contents and the like of the image data used by the image creation and cutting operations may be modified.

For example, the configuration may be modified such that only one set or the other of the image creation data or the cutting data is required to be inputted for each process. In another example, only required data is extracted from the image data and used.

In another embodiment, a plurality of inkjet nozzles 246*a*, 246*b*, . . . , 246*n* are provided on the inkjet head 226. The system is not limited to this. A single inkjet nozzle may be located on the inkjet head 226 in cases where the image creation is performed using a single color.

Incidentally, various types of ink can be employed for the ink that is sprayed from the inkjet head 226. For example, inks such as those set by irradiated light on the sheet or that have thickening properties may be used.

In another embodiment, the inkjet head 226 is arranged on the carriage 222 and the cutting head 228 is attached on the carriage 224. However, the system is not limited to this configuration. Various types of systems wherein printing is different from an inkjet format is possible. For example, an inkjet head may use a thermal transfer method. In another example, a suitable head is used for creating and cutting images are attached on the carriages 222, 224. Another configuration for the inkjet nozzles may be added to obtain better printing or cutting results.

For example, a configuration may be added in cases where the inkjet head 226 carries out the image creation using an inkjet format when the carriage 222 is positioned and stands by on the side frame 214R in the initial state. A cap may be attached to cover the inkjet nozzles 246*a*-246*n*. Thereby, the nozzles 246*a*-246*n*, when in the standby mode are capped to prevent hardening of ink or adhesion of dirt and the like. Thus, the system achieves better printing results.

Also, it is possible to change the cutter holder 74 on the cutting head 228 disposed on the carriage 224 to a pen holder. The pen holder may retain a pen such as an ink pen, a sign pen, a ball pen, a pencil, and the like, and create an image in response to the image data signal.

In addition, the place where the cutter 288 is disposed on the cutting head 28 may be changed. For example, the cutter 288*a*, as shown in FIG. 11, is positioned on the right side of the cutting head 228. However, if the cutter 288*a* were moved to the left side, the position of the cutter 288*a*, in the initial state, would become more proximal to the side frame 214L than the state shown in FIG. 11. Thus, the possibility is provided to enlarge a print processing region W3, as shown in FIG. 12.

The operating order and assembly using the image creation and cutting system 200 in accordance with the present invention are not limited to the preferred embodiment explained above. Together with being able to make appropriate selections in conformance with the conditions, it is also possible to select and set the speed of the movement of the carriages 222 and 224 for each output of the image creation and cutting system 200.

Incidentally, the implementation of the control method shown in FIG. 15 is suitable for use in those cases where a stepping motor is employed for the X motor 406, the inkjet head drive motor 240, the cutting head drive motor 256, and the actuator 286. Alternatively, the stepping motor may be replaced with a servomotor. In this case, various modifications may be made such that the states of the X motor 406, the inkjet head drive motor 240, the cutting head drive motor 256, and the actuator 286 may be always detected. Furthermore, the positions of the carriages 222 and 224, with respect to the sheet 290, may be read by the CPU 404*a* and always stored in the RAM 404*c*.

In another embodiment, the ink jet head 226 and the cutting head 228 are arranged on the front surface 216F side of the middle wall. However, the system is not limited to this and may be set up, as shown in FIGS. 16-17, such that the inkjet head 226 is arranged on the front surface 216F side of the middle wall 216 and the cutting head 228 is arranged on the back surface 216B side of the middle wall.

In this embodiment, the inkjet head 226 is supported by the carriage 222 so that movement is possible in the primary scanning direction on the guide rail 218 that extends in the primary scanning direction on the front surface 216F of the middle wall. The cutting head 228 is supported by the carriage 222 so that movement is possible in the primary scanning direction on the guide rail 218', as shown in FIG. 17, along the back surface 216B of the middle wall.

Figure 16:
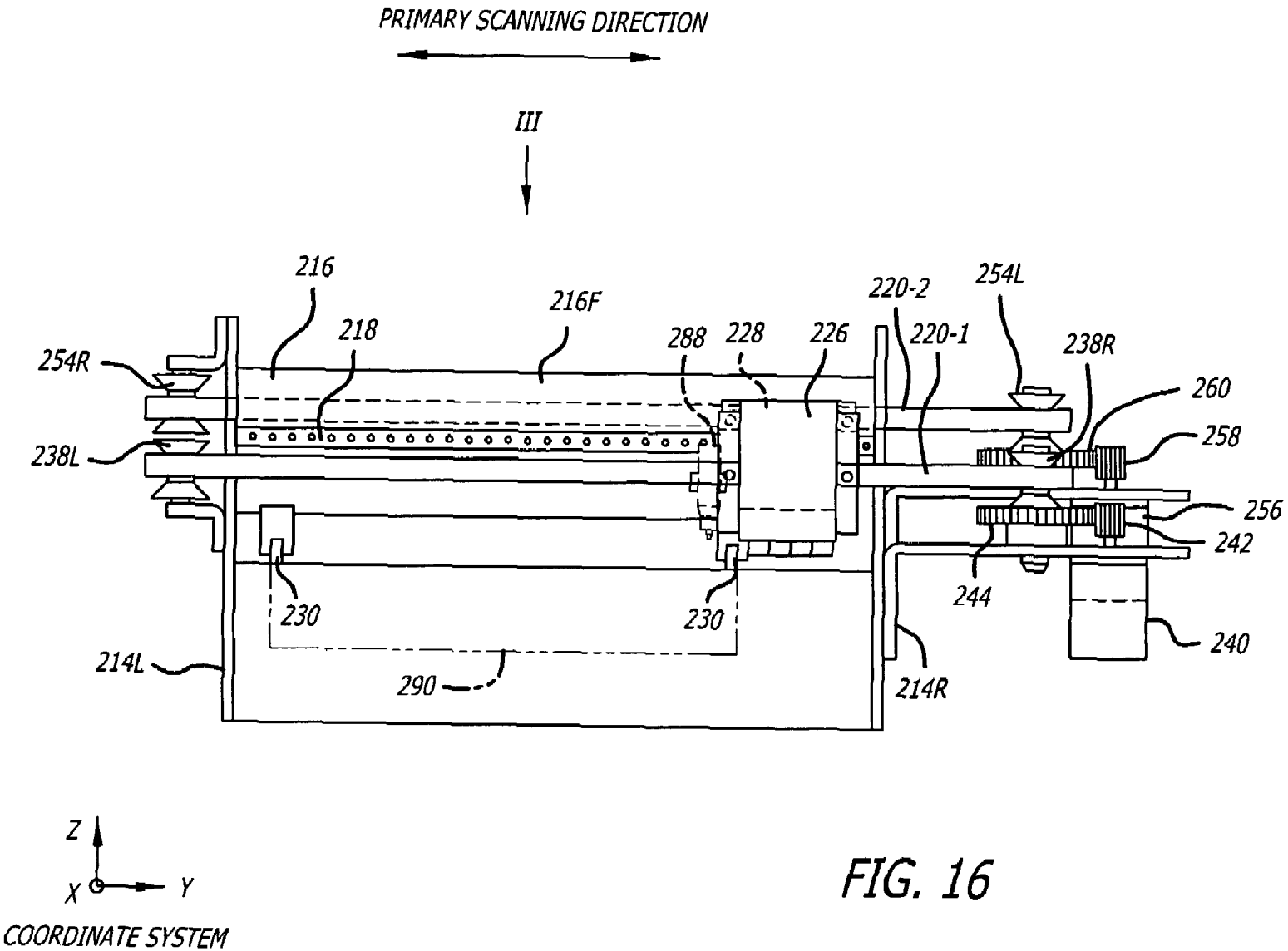
FIG. 16 is a partial top view of a system using the method described in FIG. 15, in accordance with the second embodiment of the present invention.
Figure 17:
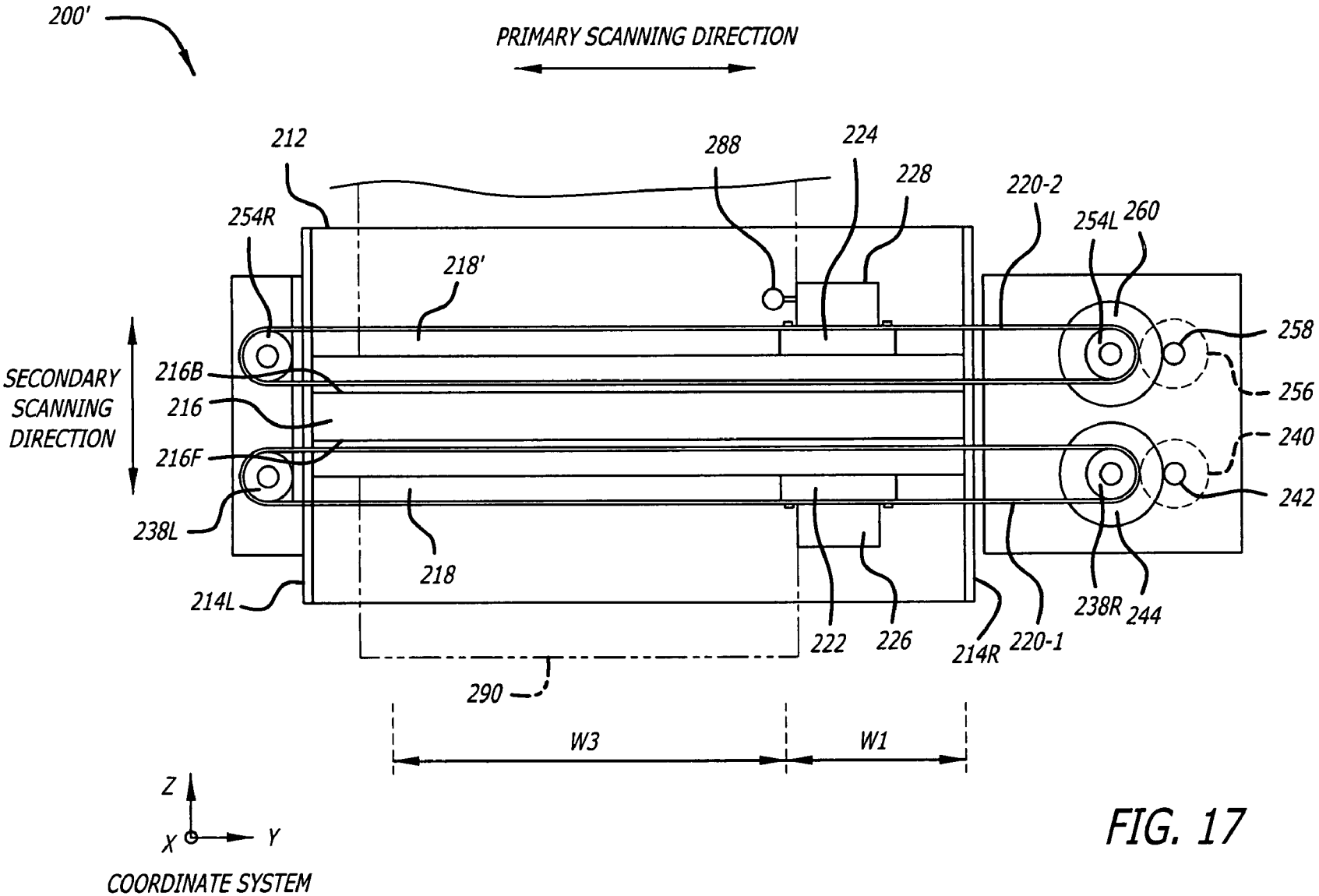
FIG. 17 is a top view illustrating a two-pulley image creation and cutting apparatus, in accordance with the second embodiment of the present invention.

Referring to FIGS. 16-17, the drive belt 220-2, the pulleys 254L, 254R, the cutting head drive motor 256, the motor gear 258, the gear 260, and the like components actuate the movement of the cutting head 228 in the primary scanning direction. The positions of these components may be modified for changes in the position of the cutting head 228. In the case where the cutting head drive motor 256 and the injector head drive motor 240 are both positioned on the side frame 214R, rather than an arrangement of two motors, one motor may be arranged and the two drive belts 220-1, 220-2 are driven by the single drive source.

In this manner, it is possible to separately move both the inkjet head 226 and the cutting head 228 along the guide rails 218, 218' disposed on the middle wall 216 using different drive systems.

Referring to FIGS. 11-13, the positional relationship between the inkjet head 226 and the cutting head 228 are side by side in the primary scanning direction and along the same coordinates in the secondary scanning direction. The W1 region where the ink jet head 226 stands by and the W2 region, where the cutting head 228 stands by in the initial state, result in the W1, W2 regions being positioned on both the left and right ends of the printing processing region W3 in the primary scanning direction.

In another case, when the configuration is made such as that shown in FIGS. 16-17, the setup becomes such that the cutting head 228 is positioned on the back surface side of the inkjet head 226 and the positional relationship of both heads is positioned back to front along the secondary scanning direction rather than lined-up in the primary scanning direction. As a result, the region in which the inkjet head 226 stands by and the region in which the cutting head 228 stands by in the initial state become such that they overlap, as shown by region W4 in FIG. 17.

Compared to the image creation and cutting system 200 (FIGS. 11-13), the overall length of the image creation and cutting system 200' (FIGS. 16-17) may be shortened in the primary scanning direction, and the miniaturization of the entire system is possible without shortening the printing processing region W3.

Incidentally, in FIGS. 16-17, the guide rails 218, 218' have been arranged on the front surface 216F and the back surface 216B of the middle wall 216. However, the system is not limited to this and may be set up such that, for example, the two guide rails may extend in any direction with the center wall 216 removed, as long as, the two guide rails are arranged without intersecting spatially.

The invention is an apparatus utilized for creating and cutting an image wherein the image is created and the image is cut. In one embodiment, an ink jet printer has a cutting head that moves the belt conveyor support vertically based on the distance detected by the sensor among the item to be processed. The cutting head and the ink jet nozzle, wherein no member protrudes upward, provide an apparatus with high cutting precision to be effectively used as a printing and cutting apparatus. It is also possible to utilize the present invention when image creation and cutting is carried out on various types of sheets such as for large sized printed items like posters and the like and for notices.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

Although the present invention is described in the context of an ink jet printer, the present invention may also be used in any printer or printing system. In addition, other ink producing heads may be utilized for creating images on object, or cutting heads, which may cut-out the created image. Moreover, the use of certain terms to describe the present invention should not limit the scope of the present invention to a certain type of printer.

What is claimed is:

1. A printer for creating and cutting an image to be processed on an object, the printer comprising:

a first guide rail extended in a specified direction;

a second guide rail positioned parallel to the first guide rail;

a first carriage supported on the first guide rail for movement on the first guide rail;

a second carriage supported on the second guide rail for movement on the second guide rail;

an inkjet head detachably coupled to the first carriage for movement on the first guide rail, the inkjet head for emitting ink onto the object to create the image;

a cutting head supported by the second carriage for movement on the second guide rail, the cutting head for cutting the object;

driving means for moving the cutting head and the inkjet head; and a controller for providing control information to the driving means.

2. The printer of claim 1, further comprising means for prohibiting movement of at least one of the cutting head and the inkjet head.

3. The printer of claim 1, wherein the controller drives the driving means to move the cutting head along the second guide rail.

4. The printer of claim 1, wherein the controller drives the driving means to move the first carriage along the first guide rail.

5. The printer of claim 4, wherein the inkjet head is detachably coupled to the first carriage by a first linking means and detachably coupled to a base member by a fastening means.

6. The printer of claim 5 wherein the inkjet head moves as a single unit with the first carriage along the first guide rail when the inkjet head is coupled to the first carriage by the first linking means.

7. The printer of claim 5, wherein the inkjet head does not move along the first guide rail when the inkjet head is coupled to the base member by the fastening means.

8. The printer of claim 7, wherein the controller controls the fastening means for coupling with the inkjet bead.

9. The printer of claim 1, further comprising a drive belt attached to the cutting head for providing a second linking means for linking with the first linking means.

10. The printer of claim 9, wherein the driving means drives the drive belt and the controller drives the drive means to link the second linking means and the first linking means upon the image being created.

11. The printer of claim 10, further comprising means for driving the drive belt and the cutting head along the second guide rail as a single unit.

12. The printer of claim 11, wherein when the second linking means and the first linking means are linked, the inkjet head moves on the first guide rail.

13. The printer of claim 12, wherein when the first carriage moves along the first guide rail, and cutting of the image is carried out, the drive belt moves with the first carriage and the second linking means and the first linking means are not linked.

14. The printer of claim 13, wherein the driving means causes the drive belt and the cutting head to move along the second guide rail.

15. The printer of claim 1, further comprising a cap for protecting the inkjet head.

16. The printer of claim 15, wherein the cap caps at least one nozzle of the inkjet head when the inkjet head is not in use.

17. A printer for creating and cutting an image to be processed from a sheet, the printer comprising:

an inkjet head mounted on a first carriage for movement in a first direction and a second direction and emitting ink on the sheet to create an image in response to image data;

a cutting head mounted on a second carriage for movement in the first direction from a standard position and for movement in the second direction, the second direction being opposite to the first direction, before returning to the standard position, wherein a cutter is coupled to the cutting head for cutting the sheet while moving;

a fastening section coupled between the inkjet head and a fastening group base member for movement of the inkjet head in the first and second directions; and a moving member for movement when the cutting head moves in the first direction, the moving member moves in the second direction, and when the cutting head moves in the second direction, the moving member moves in the first direction.

18. The printer of claim 17, further comprising a linking section for detachably coupling the moving member and the inkjet head.

19. The printer of claim 18, further comprising means for driving the cutting head in the first direction or the second direction for cutting the image in response to the image data, wherein:

the cutting head is moved in the second direction by the drive means and passes through the standard position;

the moving member moves in the first direction and in the second direction of the cutting head; and the moving member and the inkjet head are linked by the linking section.

20. The printer of claim 18, wherein the linking section comprises a magnet and an attachment unit attached to the magnet by a magnetic force of the magnet, the magnet and the attachment unit each alternatively arranged on a the first carriage that supports the inkjet head so such that the inkjet head is free to move, and the magnetic force between the magnet and the attachment unit is less than a fastening force with which the fastening section fastens the inkjet head to the fastening group base member.

21. The printer of claim 17, wherein the inkjet head is detached from the fastening group member and is moved as a single unit with the moving member together with the movement of the cutting head, wherein if the cutting of the image is carried out in response to the image data, the cutting head is moved in the first direction from the standard position by the drive means, and is moved in the second direction and returned to the standard position.

22. The printer of claim 17, wherein the linking section comprises a first magnet disposed on the moving member and a second magnet on the first carriage that supports the inkjet head for movement in both an X and Y direction of the ink jet head.

23. The printer of claim 22, wherein the first and the second magnets have a magnetic attractive force less than a fastening force of the fastening section for facilitating attachment of the inkjet head to the fastening group member.

24. The printer of claim 17, further comprising a cap for protecting the inkjet head.

25. The printer of claim 24, wherein the cap caps at least one nozzle of the inkjet head when the inkjet head is not in use.

* * * * *